US009233480B2

(12) United States Patent
Nagai et al.

(10) Patent No.: US 9,233,480 B2
(45) Date of Patent: Jan. 12, 2016

(54) CUTTING APPARATUS, HOLDING MEMBER FOR HOLDING OBJECT TO BE CUT AND STORAGE MEDIUM STORING CUTTING CONTROL PROGRAM

(75) Inventors: Masahiko Nagai, Nagoya (JP); Yasuhiko Kawaguchi, Nagoya (JP); Yoshinori Nakamura, Toyohashi (JP); Tomoyasu Niizeki, Ichinomiya (JP); Katsuhisa Hasegawa, Kasugai (JP)

(73) Assignee: BROTHER KOGYO KABUSHIKI KAISHA, Nagoya-shi (JP)

( * ) Notice: Subject to any disclaimer, the term of this patent is extended or adjusted under 35 U.S.C. 154(b) by 593 days.

(21) Appl. No.: 13/432,034

(22) Filed: Mar. 28, 2012

(65) Prior Publication Data

US 2012/0247293 A1 Oct. 4, 2012

(30) Foreign Application Priority Data

Mar. 30, 2011 (JP) ..... 2011-075580
Sep. 27, 2011 (JP) ..... 2011-210760

(51) Int. Cl.

| | |
|---|---|
| ***B26D 5/20*** | (2006.01) |
| ***B26F 1/38*** | (2006.01) |
| ***B26D 5/30*** | (2006.01) |
| *B26D 5/00* | (2006.01) |
| *B26D 5/02* | (2006.01) |

(52) U.S. Cl.

CPC ..... *B26F 1/3806* (2013.01); *B26D 5/30* (2013.01); *B26D 5/005* (2013.01); *B26D 5/02* (2013.01); *Y10T 83/166* (2015.04); *Y10T 83/748* (2015.04)

(58) Field of Classification Search

CPC ..... B26F 1/3806; B26D 5/30; Y10T 83/166; Y10T 83/748

USPC ..... 83/76.3, 72, 74, 75, 527, 76.1

See application file for complete search history.

(56) References Cited

U.S. PATENT DOCUMENTS

| | | | | |
|---|---|---|---|---|
| 5,200,592 | A | 4/1993 | Yabu | |
| 7,054,708 | B1 * | 5/2006 | Aamodt et al. | 700/122 |
| 7,930,958 | B2 * | 4/2011 | Workman et al. | 83/397.1 |
| 7,932,809 | B2 * | 4/2011 | Nair et al. | 340/5.2 |
| 8,646,366 | B2 * | 2/2014 | Workman et al. | 83/76.9 |
| 8,708,590 | B2 * | 4/2014 | Johnson et al. | 400/619 |
| 2005/0186010 | A1 | 8/2005 | Shibata et al. | |

(Continued)

FOREIGN PATENT DOCUMENTS

| | | | |
|---|---|---|---|
| JP | 4146261 | A | 5/1992 |
| JP | 2005205541 | A | 8/2005 |

(Continued)

*Primary Examiner* — Omar Flores Sanchez
(74) *Attorney, Agent, or Firm* — Fox Rothschild LLP

(57) ABSTRACT

A cutting apparatus includes a cutting unit including a cutting blade, a holding member having an adhesive layer on which an object to be cut is removably held, a wireless tag containing cutting information, a reading unit reading the cutting information from the wireless tag when the holding member has been set on the apparatus, and a control unit controlling the cutting unit based on the cutting information the reading unit has read from the wireless tag. The cutting information includes at least one of a relative moving speed between the blade and the object, a pressing force of the blade against the object and a correction amount which corrects a relative movement amount of the blade relative to the object. The cutting unit includes a pressing unit which presses the object held by the holding member, and the cutting information includes a pressing force of the pressing unit.

13 Claims, 18 Drawing Sheets

(56) References Cited

U.S. PATENT DOCUMENTS

| | | | | |
|---|---|---|---|---|
| 2006/0117922 | A1* | 6/2006 | Causse et al. | 83/76.3 |
| 2007/0012147 | A1* | 1/2007 | Kawai et al. | 83/72 |
| 2007/0012148 | A1* | 1/2007 | Workman et al. | 83/76.3 |
| 2008/0134853 | A2* | 6/2008 | Causse et al. | 83/76.3 |
| 2008/0282859 | A2* | 11/2008 | Causse et al. | 83/76.3 |
| 2012/0247293 | A1* | 10/2012 | Nagai et al. | 83/76.3 |
| 2013/0139662 | A1* | 6/2013 | Greyshock et al. | 83/14 |
| 2014/0182431 | A1* | 7/2014 | Hasegawa et al. | 83/72 |

FOREIGN PATENT DOCUMENTS

| | | | |
|---|---|---|---|
| JP | 2005246562 | A | 9/2005 |
| JP | 2012-206232 | A | 10/2012 |

* cited by examiner

| HOLDING SHEET TYPE | CUTTER PRESSURE DATA | PRESSING MEMBER PRESSURE DATA | SPEED DATA | CORRECTION DATA |
|---|---|---|---|---|
| A (FOR PAPER) | LOW | LOW | LOW | NONE |
| B (FOR FELT) | MIDDLE | MIDDLE | HIGH | LARGE |
| C (FOR DENIM) | HIGH | HIGH | HIGH | SMALL |
| D (FOR BROADCLOTH) | LOW | HIGH | HIGH | MIDDLE |

FIG.13

FULL COVERGA DATA

| NUMBER OF PATTERNS | |
|---|---|
| PATTERN CONTOUR Fa (CUTTING 1) | FIRST COORDINATE DATA<br>SECOND COORDINATE DATA<br>THIRD COORDINATE DATA<br>FOURTH COORDINATE DATA<br>FIFTH COORDINATE DATA |
| CONTOUR SEPARATION DATA | |
| PATTERN CONTOUR Fb (CUTTING 2) | FIRST COORDINATE DATA<br>SECOND COORDINATE DATA<br>THIRD COORDINATE DATA<br>FOURTH COORDINATE DATA<br>FIFTH COORDINATE DATA |
| CONTOUR SEPARATION DATA | |
| PATTERN CONTOUR Fc (CUTTING 3) | FIRST COORDINATE DATA<br>SECOND COORDINATE DATA<br>THIRD COORDINATE DATA<br>FOURTH COORDINATE DATA<br>FIFTH COORDINATE DATA |
| CONTOUR SEPARATION DATA | |
| | |
| | |
| CONTOUR SEPARATION DATA | |
| PATTERN CONTOUR Fl (CUTTING 12) | FIRST COORDINATE DATA<br>SECOND COORDINATE DATA<br>THIRD COORDINATE DATA<br>FOURTH COORDINATE DATA<br>FIFTH COORDINATE DATA |
| CONTOUR SEPARATION DATA | |

FIG.19

CUTTING APPARATUS, HOLDING MEMBER FOR HOLDING OBJECT TO BE CUT AND STORAGE MEDIUM STORING CUTTING CONTROL PROGRAM

CROSS-REFERENCE TO RELATED APPLICATIONS

This application is based upon and claims the benefit of priority from the prior Japanese Patent Application Nos. 2011-075580 filed on Mar. 30, 2011 and 2011-210760 filed on Sep. 27, 2011, the entire contents of which are incorporated herein by reference.

BACKGROUND

1. Technical Field

The present disclosure relates to a cutting apparatus in which a cutting blade and an object to be cut are moved relative to each other so that the object is cut by the cutting blade, a holding member which is fed into the cutting apparatus while holding the object and a computer-readable storage medium storing a control program used to cut a desired pattern out of the object.

2. Related Art

There has conventionally been known a cutting plotter which automatically cuts a sheet such as paper, for example. In the cutting plotter, an object to be cut is inserted between a driving roller and a pinch roller of a drive mechanism from above and below thereby to be held therebetween. The object is then moved in a first direction while being held in the aforementioned manner and a carriage with a cutting blade is moved in a second direction perpendicular to the first direction, thereby cutting the object.

The aforementioned cutting plotter includes a type that an operating condition is settable according to a type of the cutting blade. The operating condition includes a relative moving speed of the cutting blade relative to the object, a pressing force applied to the cutting blade and the like. More specifically, a bar code indicative of a type of the object is attached to an upper surface of the object. The carriage is provided with a sensor which reads the bar code of the object set on the cutting plotter. Before the set object is cut, the sensor reads the bar code to detect the type of the object. The operating condition is set according to the detected type.

Furthermore, another cutting plotter is also known in which an object to be cut is applied to a sheet-like member (corresponding to a holding member) having an upper surface with an adhesive layer formed by application of an adhesive agent. The sheet-like member is moved in the first direction so that the object is cut.

The above-described former cutting plotter detects the type of the object thereby to be capable of executing the cutting on the basis of the operating condition according to the object type.

It is considered whether or not the holding member of the above-described latter cutting plotter can be used with the former cutting plotter. In this case, too, the type of the object is detected such that the object can be cut on the basis of the operating condition according to the type of the object. However, the object cannot reliably be held by the holding member when the adhesive layer of the holding member has an adhesion unsuitable to the type of the object, whereupon there is a possibility that the object may be displaced from the holding member. The object cannot be cut accurately when not being reliably held by the holding member.

SUMMARY

Therefore, an object of the disclosure is to provide a cutting apparatus in which the object can reliably be held by the holding member such that the object can accurately be cut, and also to provide a holding member for use with the cutting apparatus and a storage medium storing a control program.

The present disclosure provides a cutting apparatus comprising a cutting unit including a cutting blade moved together with an object to be cut, relative to each other, thereby cutting the object by the cutting blade; a holding member having an adhesive layer on which the object is removably held, the holding member being set onto the cutting apparatus while adhesively holding the object; a wireless tag provided on the holding member and containing cutting information written thereon, the cutting information including information about cutting; a reading unit which reads the cutting information from the wireless tag when the holding member has been set on the cutting apparatus; and a control unit which controls the cutting unit based on the cutting information the reading unit has read from the wireless tag. In the cutting apparatus, the cutting information includes at least one of a relative moving speed between the cutting blade and the object, a pressing force of the cutting blade against the object and an amount of correction which corrects an amount of relative movement of the cutting blade relative to the object. The cutting unit includes a pressing unit which presses the object held by the holding member, and the cutting information includes a pressing force of the pressing unit.

BRIEF DESCRIPTION OF THE DRAWINGS

In the accompanying drawings:

FIG. 13 is a graph showing types of holding sheets and cutting parameters associated with each other;

FIG. 19 is a view explaining the structure of full coverage data including data of a plurality of contours;

DETAILED DESCRIPTION

Figure 1:
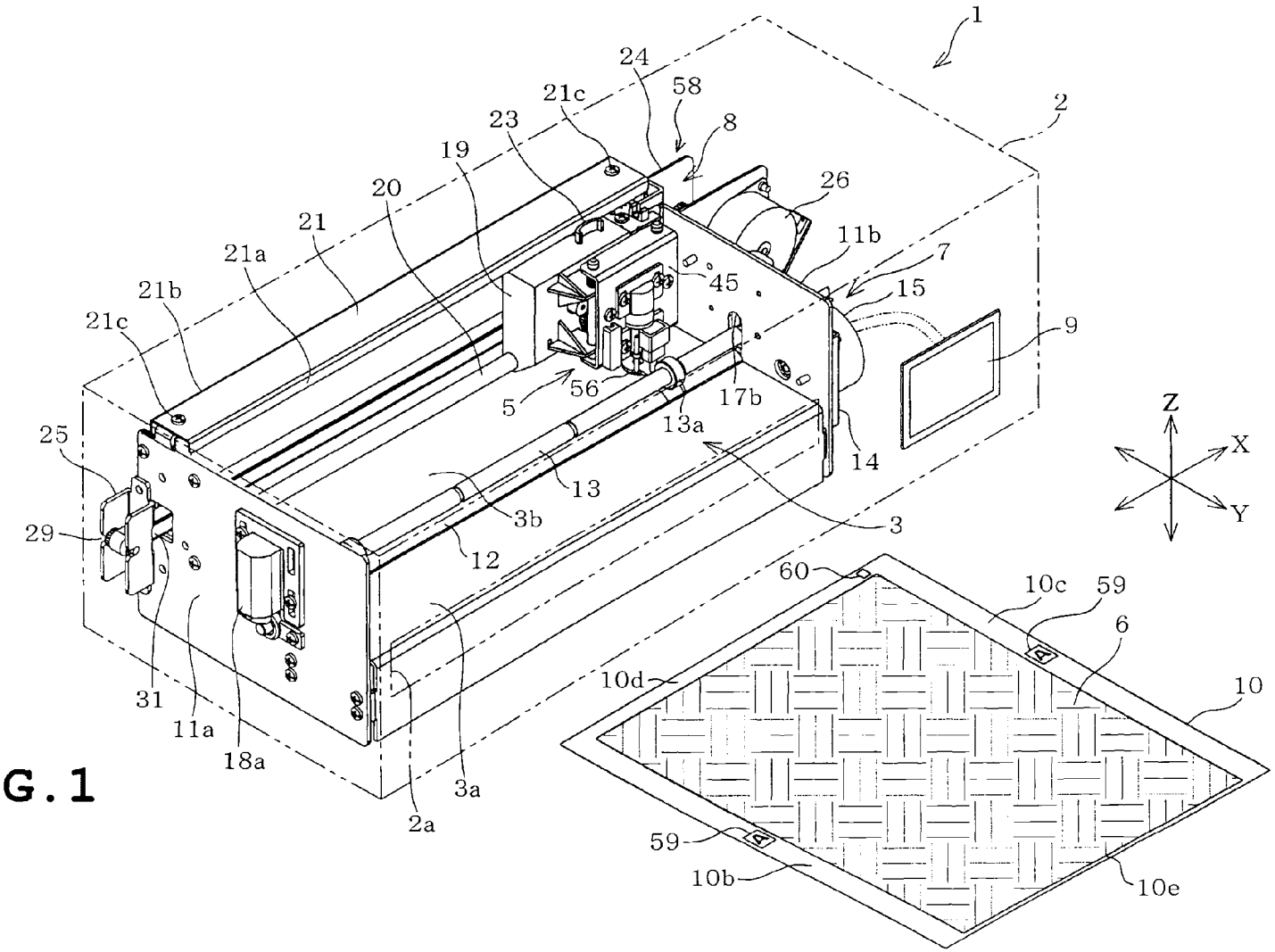
FIG. 1 is a perspective view of the cutting apparatus according to a first embodiment, showing an inner structure thereof.

A first embodiment will be described with reference to FIGS. 1 to 16. Referring to FIG. 1, a cutting apparatus 1 includes a body cover 2 as a housing, a platen 3 provided in the body cover 2 and a cutter holder 5. The cutting apparatus 1 also includes first and second moving units 7 and 8 for moving a cutter 4 (see FIG. 5) of the cutter holder 5 and an object 6 to be cut relative to each other. The body cover 2 is formed into the shape of a horizontally long rectangular box and has a front formed with a horizontally long opening 2*a* which is provided for setting a holding sheet 10 holding the object 6. In the following description, the side where the user who operates the cutting apparatus 1 stands will be referred to as "front" and the opposite side will be referred to as "back." The front-back direction thereof will be referred to as "Y direction" as shown in FIG. 1. Furthermore, the side where the pillar 3 is located will be referred to as "right" and the opposite side will be referred to as "left." The right-left direction of a sewing machine 1 will be referred to as "X direction."

On a right part of the front of the body cover 2 is provided a liquid crystal display (LCD) 9 which serves as a display unit displaying messages and the like necessary for the user. A plurality of operation switches 65 (see FIG. 10) is also provided on the right part of the front of the body cover 2. The user operates the operation switches 65 to enter various instructions, selections and other input operations. The platen 3 includes a pair of front and rear plate members 3*a* and 3*b* and has an upper surface which is configured into an XY plane serving as a horizontal plane. The platen 3 is set so that a holding sheet 10 holding the object 6 is placed thereon. The holding sheet 10 is received by the platen 3 when the object 6 is cut. The holding sheet 6 has an upper surface with an adhesive layer (see FIG. 8) 10*a* formed by applying an adhesive agent to a part thereof except for a left edge 10*b*, a right edge 10*c* and a rear edge 10 and a front edge thereof. The object 6 is attached to the adhesive layer 10*a* of the holding sheet 10.

Figure 2:
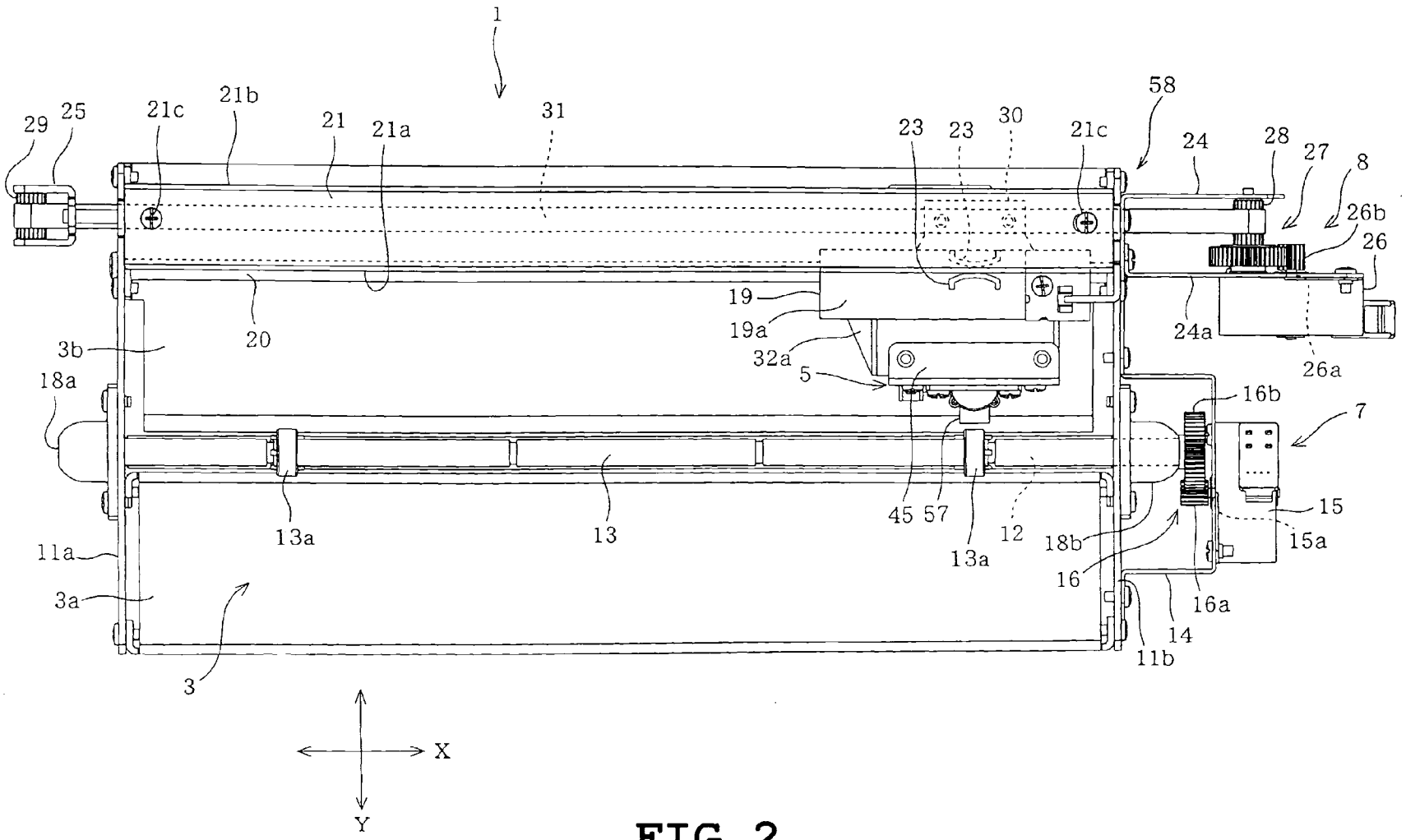
FIG. 2 is a plan view of the cutting apparatus.

The first moving unit 7 moves the holding sheet 10 on the upper surface side of the platen 3 in the Y direction (a first direction). More specifically, a driving roller 12 and a pinch roller 13 are provided on right and left sidewalls 11*b* and 11*a* so as to be located between plate members 3*a* and 3*b*. The driving roller 12 and the pinch roller 13 extend in the X direction and are rotatably supported on the sidewalls 11*a* and 11*b*. The driving roller 12 and the pinch roller 13 are disposed so as to be parallel to the X-Y plane and so as to be vertically arranged. The driving roller 12 is located lower than the pinch roller 13. A first crank-shaped mounting frame 14 is provided on the right sidewall 11*b* so as to be located on the right of the driving roller 12 as shown in FIG. 2. A Y-axis motor 15 is fixed to an outer surface of the mounting frame 14. The Y-axis motor 15 comprises a stepping motor, for example and has a rotating shaft 15*a* extending through the first mounting frame 14 and further has a distal end provided with a gear 16*a*. The driving roller 12 has a right end to which is secured another gear 16*b* which is brought into mesh engagement with the gear 16*a*. These gears 16*a* and 16*b* constitute a first reduction gear mechanism 16. The pinch roller 13 is guided by guide grooves 17*b* formed in the right and left sidewalls 11*b* and 11*a* so as to be movable upward and downward. Only the right guide groove 17*b* is shown in FIG. 1. Two spring accommodating members 18*a* and 18*b* are mounted on the right and left sidewalls 11*b* and 11*a* in order to cover the guide groove 17*b* from the outside respectively. The pinch roller 13 is biased downward by compression coil springs (not shown) accommodated in the spring accommodating portions 18*a* and 18*b* respectively. The pinch roller 13 is provided with pressing portions 13*a* which are brought into contact with a left edge 10*b* and a right edge 10*c* of the holding sheet 10, thereby pressing the edges 10*b* and 10*c*, respectively. Each pressing portion 13*a* has a slightly larger outer diameter than the other portion of the pinch roller 13.

The driving roller 12 and the pinch roller 13 press the holding sheet 10 from below and from above by the urging force of the compression coil springs thereby to hold the holding sheet 10 therebetween (see FIG. 9). Upon drive of the Y-axis motor 15, normal or reverse rotation of the Y-axis motor 15 is transmitted via the first reduction gear mechanism 16 to the driving roller 12, whereby the holding sheet 10 is moved backward or forward together with the object 6. The first moving unit 7 is thus constituted by the driving roller 12, the pinch roller 13, the Y-axis motor 15, the first reduction gear mechanism 16, the compression coil springs and the like.

The second moving unit 8 moves a carriage 19 supporting the cutter holder 5 in the X direction (a second direction). The second moving unit 8 will be described in more detail. A guide shaft 20 and a guide frame 21 both extending in the right-left direction are provided between the right and left sidewalls 11*b* and 11*a* so as to be located at the rear end of the cutting apparatus 1, as shown in FIGS. 1 and 2. The guide shaft 20 is disposed in parallel with the driving roller 12 and the pinch roller 13. The guide shaft 20 located right above the platen 3 extends through a lower part of the carriage 19 (a through hole 22 as will be described later). The guide frame 21 has a front edge 21*a* and a rear edge 21*b* both folded downward such that the guide frame 21 has a generally C-shaped section. The front edge 21*a* is disposed in parallel with the guide shaft 20. The guide frame 21 is adapted to guide an upper part (guided members 23 as will be described later) of the carriage 19 by the front edge 21*a*. The guide frame 21 is fixed to upper ends of the sidewalls 11*a* and 11*b* by screws 21*c* respectively.

A second mounting frame 24 is mounted on the right sidewall 11*b* in the rear of the cutting apparatus 1, and an auxiliary frame 25 is mounted on the left sidewall 11*a* in the rear of the cutting apparatus 1, as shown in FIG. 2. An X-axis motor 26 and a second reduction gear mechanism 27 are provided on the second mounting frame 24. The X-axis motor 26 comprises a stepping motor, for example and is fixed to a front of a front mounting piece 24*a*. The X-axis motor 26 includes a rotating shaft 26*a* which extends through the mounting piece 24*a* and has a distal end provided with a gear 26*b* which is brought into mesh engagement with the second reduction gear mechanism 27. A pulley 28 is rotatably mounted on the second reduction gear mechanism 27, and another pulley 29 is rotatably mounted on the left auxiliary frame 25. An endless timing belt 31 connected to a rear end (a mounting portion 30 as will be described later) of the carriage 19 extends between the pulleys 28 and 29.

Upon drive of the X-axis motor 26, normal or reverse rotation of the X-axis motor 26 is transmitted via the second reduction gear mechanism 27 and the pulley 28 to the timing belt 31, whereby the carriage 19 is moved leftward or rightward together with the cutter holder 5. Thus, the carriage 19 and the cutter holder 5 are moved in the X direction perpendicular to the Y direction in which the object 6 is conveyed. The second moving unit 8 is constituted by the above-described guide shaft 20, the guide frame 21, the X-axis motor 26, the second reduction gear mechanism 27, the pulleys 28 and 29, the timing belt 31, the carriage 19 and the like.

Figure 3:
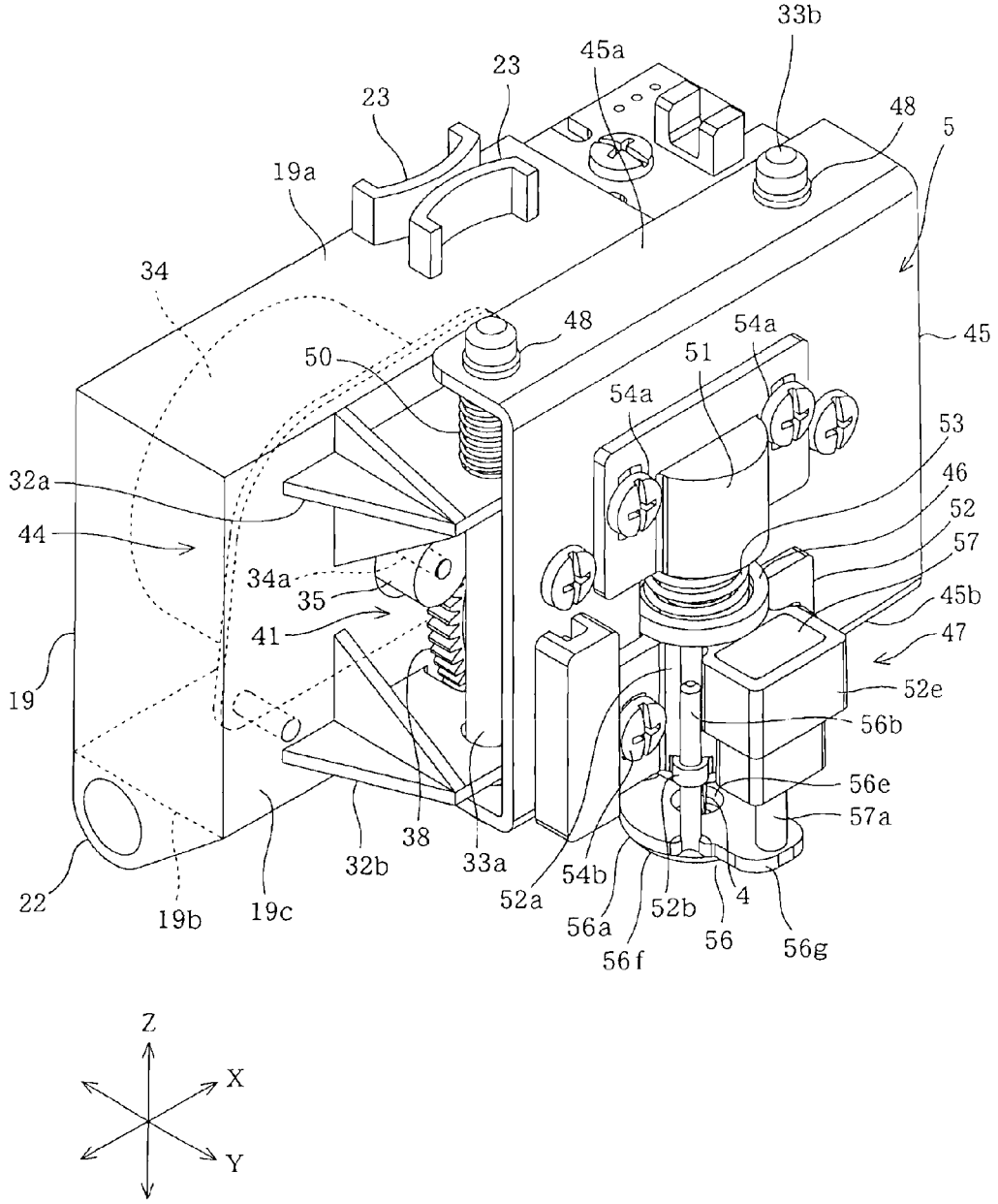
FIG. 3 is a perspective view of a cutter holder.
Figure 4:
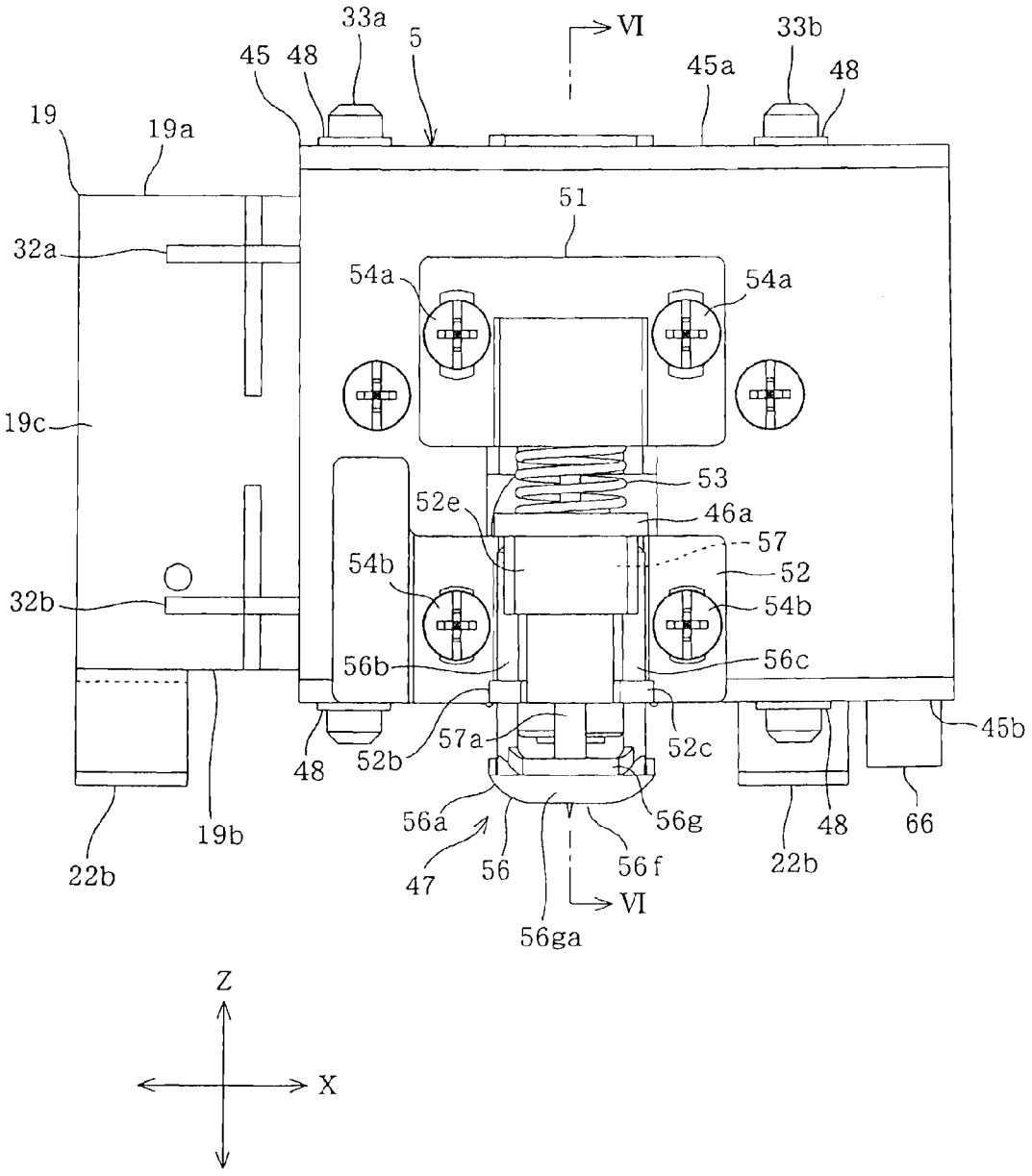
FIG. 4 is a front view of the cutter holder, showing the state where a cutter has been descended.
Figure 5:
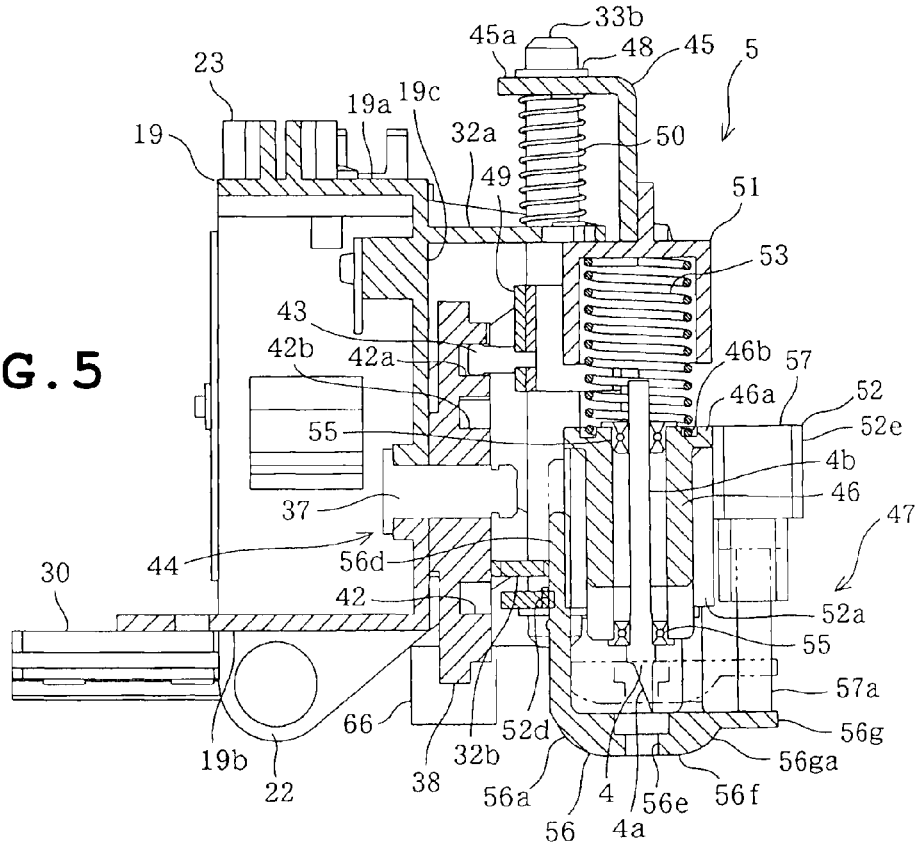
FIG. 5 is a sectional view of the cutter holder, showing the case where the cuter has been ascended.
Figure 6:
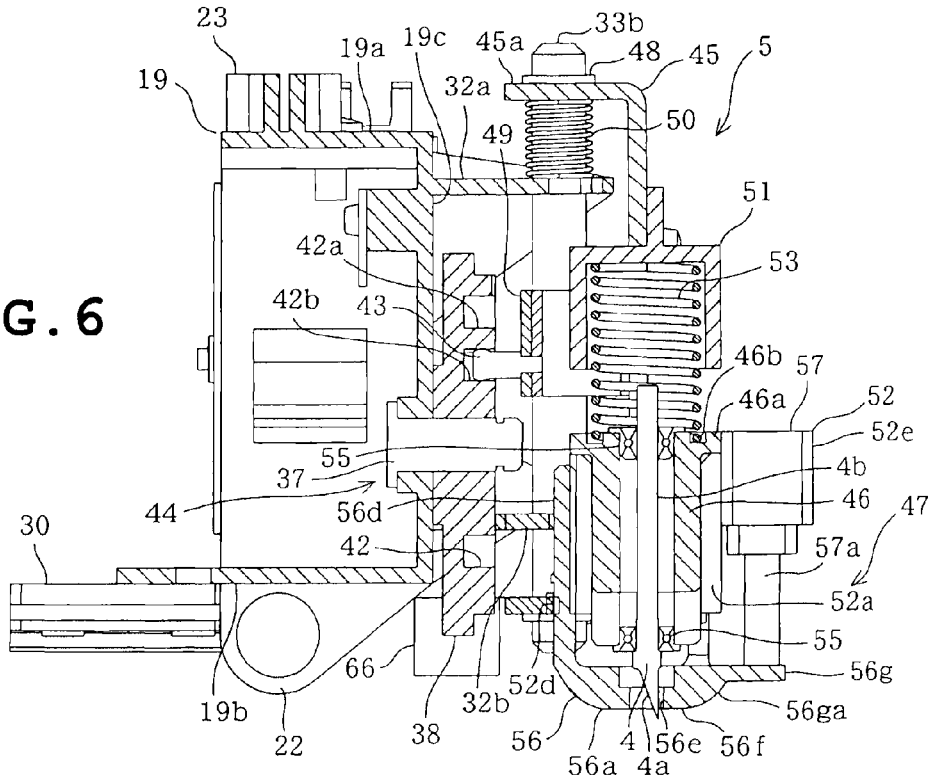
FIG. 6 is a sectional view taken along lines VI-VI in FIG. 4.

The cutter holder 5 is disposed on the front of the carriage 19 and is supported so as to be movable in a vertical direction (a third direction) serving as a Z direction. The carriage 19 and the cutter holder 5 will be described with reference to FIGS. 3 to 9 as well as FIGS. 1 and 2. The carriage 19 is formed into the shape of a substantially rectangular box with an open rear as shown in FIGS. 2 and 3. The carriage 19 has an upper wall 19*a* with which a pair of upwardly protruding front and rear guided members 23 are integrally formed. The guided members 23 are arc-shaped ribs as viewed in a planar view. The guided members 23 are symmetrically disposed with a front edge 21*a* of the guide frame 21 being interposed therebetween. The carriage 19 has a bottom wall 19*b* further having a downwardly expanding portion which is formed with a pair of right and left through holes 22 through which the guide shaft 20 is inserted, as shown in FIGS. 4, 5 and 6. An attaching portion 30 (see FIGS. 5 and 6) is mounted on the bottom wall 19*b* of the carriage 19 so as to protrude rearward. The attaching portion 30 is to be coupled with the timing belt 31. The carriage 19 is thus supported by the guide shaft 20 inserted through the holes 22 so as to be slidable in the right-left direction and further supported by the guide frame 21 held between the guided members 23 so as to be prevented from being rotated about the guide shaft 20.

Figure 9:
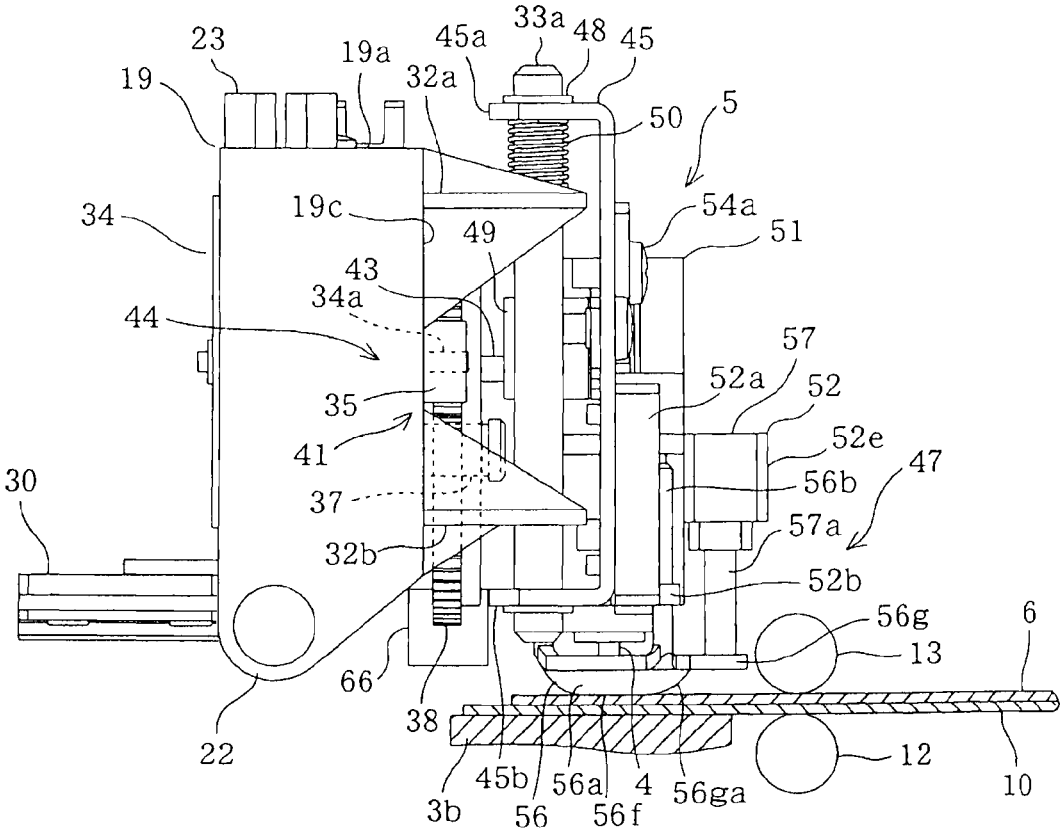
FIG. 9 is a view of the vicinity of a cutter holder during the cutting.

The carriage 19 has a front wall 19*c* with which a pair of upper and lower support portions 32*a* and 32*b* are formed so as to extend forward as shown in FIGS. 3 to 5, 9, etc. A pair of right and left support shafts 33*b* and 33*a* extending through the respective support portions 32*a* and 32*b* are mounted on the carriage 19 so as to be vertically movable. A Z-axis motor 34 comprising, for example, a stepping motor is accommodated in the carriage 19 backward thereby to be housed therein. The Z-axis motor 34 has a rotating shaft 34*a* (see FIGS. 3 and 9) which extends through the front wall 19*c* of the carriage 19. The rotating shaft 34*a* has a distal end provided with a gear 35. Furthermore, the carriage 19 is provided with a gear shaft 37 which extends through a slightly lower part of the gear 35 relative to the central part of the front wall 19*c* as shown in FIGS. 5, 6 and 9. A gear 38 which is brought into mesh engagement with the gear 35 in front of the front wall 19*c* is rotatably mounted on the gear shaft 37. The gear 38 is retained by a retaining ring (not shown) mounted on a front end of the gear shaft 37. The gears 35 and 38 constitute a third reduction mechanism 41 (see FIGS. 3 and 9).

Figure 7:
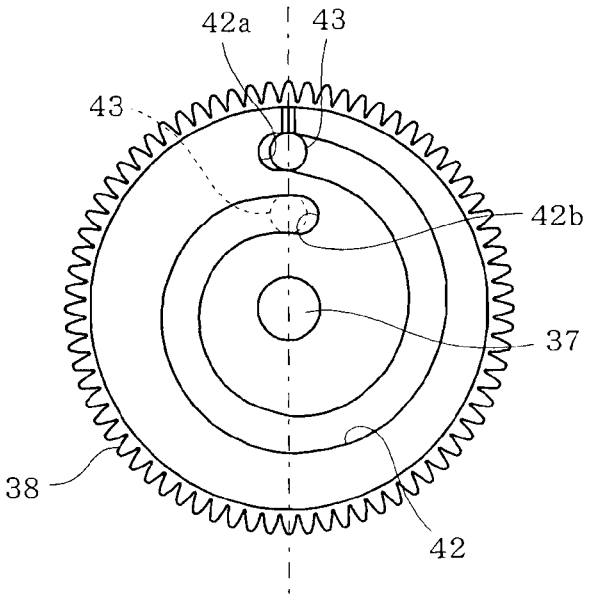
FIG. 7 is an enlarged front view of a gear.

The gear 38 is formed with a spiral groove 42 as shown in FIG. 7. The spiral groove 42 is a cam groove formed into a spiral shape such that the spiral groove 42 comes closer to the center of the gear 38 as it is turned rightward from a first end 42*a* toward a second end 42*b*. An engagement pin 43 which is vertically moved together with the cutter holder 5 engages the spiral groove 42 (see FIGS. 5 and 6) as will be described in detail later. Upon normal or reverse rotation of the Z-axis motor 34, the gear 38 is rotated via the gear 35. Rotation of the gear 38 vertically slides the engagement pin 43 in engagement with the spiral groove 42. With the vertical slide of the gear 38, the cutter holder 5 is moved upward or downward together with the support shafts 33*a* and 33*b*. In this case, the cutter holder 5 is moved between a raised position (see FIGS. 5 and 7) where the engagement pin 43 is located at the first end 42*a* of the spiral groove 42 and a lowered position (see FIGS. 6 and 7) where the engagement pin 43 is located at the second end 42*b*. A third moving unit 44 which moves the cutter holder 5 upward and downward is constituted by the above-described third reduction mechanism 41 having the spiral groove 42, the Z-axis motor 34, the engagement pin 43, the support portions 32*a* and 32*b*, the support shafts 33*a* and 33*b*, etc.

The cutter holder 5 includes a holder body 45 provided on the support shafts 33*a* and 33*b*, a movable cylindrical portion 46 which has a cutter 4 (a cutting blade) and is held by the holder body 45 so as to be vertically movable and a pressing device 47 which presses the object 6. More specifically, the holder body 45 has an upper end 45*a* and a lower end 45*b* both of which are folded rearward such that the holder body 45 is generally formed into a C-shape, as shown in FIGS. 3 to 5, 9 and the like. The upper and lower ends 45*a* and 45*b* are immovably fixed to the support shafts 33*a* and 33*b* by retaining rings 48 fixed to upper and lower ends of the support shafts 33*a* and 33*b*, respectively. The support shaft 33*b* has a middle part to which is secured a coupling member 49 provided with a rearwardly directed engagement pin 43 as shown in FIGS. 5 and 6. The holder body 45, support shafts 33*a* and 33*b*, the engagement pin 43 and the coupling member 40 are formed integrally with one another as shown in FIGS. 5 and 6. The cutter holder 5 is vertically moved by the third moving unit 44 in conjunction with the engagement pin 43. Furthermore, compression coil springs 50 serving as biasing members are mounted about the support shafts 33*a* and 33*b* so as to be located between upper surfaces of the support portion and upper end of the holder boy 45, respectively. The entire cutter holder 5 is elastically biased upward by biasing force of the compression coil springs 50.

A tag reader/writer 66 is mounted on a right part of the underside of the lower end 45*b* of the holder body 45 as shown in FIG. 4. The tag reader/writer 66 will be described in detail later. The tag reader/writer 66 is formed integrally with the holder body 45 to transmit and receive information about the cutting in a non-contact manner with a wireless tag 60 which will be described later. The tag reader/writer 66 may be provided on the body cover 2 or the platen 3, instead of the holder body 45. In other words, the tag reader/writer 66 can be provided in a transmissible/receivable range with respect to the wireless tag 60, and the location of the tag reader/writer 66 should not be limited.

Mounting members 51 and 52 provided for mounting the movable cylindrical portion 46, the pressing device 47 and the like are fixed to the middle portion of the holder body 45 by screws 54*a* and 54*b* respectively, as shown in FIGS. 3 and 4. The lower mounting member 52 is provided with a cylindrical portion 52*a* (see FIG. 5) which supports the movable cylindrical portion 46 so that the movable cylindrical portion 46 is vertically movable. The movable cylindrical portion 46 has a diameter that is set so that the movable cylindrical portion 46 is brought into sliding contact with the inner peripheral surface of the cylindrical portion 52*a*. The movable cylindrical portion 46 has an upper end on which a flange 46*a* supported on an upper end of the cylindrical portion 52*a* is formed so as to expand radially outward. A spring shoe 46*b* is provided on an upper end of the flange 46*a*. A compression coil spring 53 is interposed between the upper mounting member 51 and the spring shoe 46*b* of the movable cylindrical portion 46 as shown in FIGS. 5 and 6. The compression coil spring 53 biases the movable cylindrical portion 46 (the cutter 4) to the lower object 6 side while allowing the upward movement of the movable cylindrical portion 46 against the biasing force when an upward force acts on the cutter 4.

Figure 8:
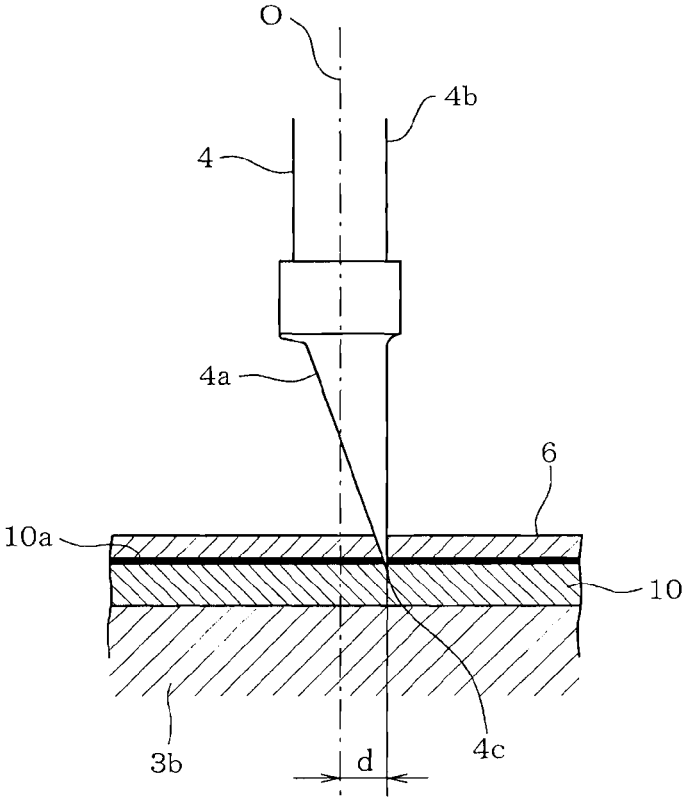
FIG. 8 is an enlarged view of the vicinity of a distal end of the cutter during the cutting.

The cutter 4 is provided in the movable cylindrical portion 46 so as to extend therethrough in the axial direction. In more detail, the cutter 4 has a round bar-like cutter shaft 4*b* which is longer than the movable cylindrical portion 46 and a blade 4*a* integrally formed on a lower end of the cutter shaft 4*b*. The blade 4*a* is formed into a substantially triangular shape and has a lowermost blade edge 4*c* formed at a location offset by a distance d from a central axis O of the cutter shaft 4*b*, as shown in FIG. 8. The cutter 4 is held by bearings 55 (see FIG. 5) mounted on upper and lower ends of the movable cylindrical portion 46 so as to be rotatably movable about the central axis O (the Z axis) in the vertical direction. Thus, the blade edge 4*c* of the cutter 4 presses an X-Y plane or the surface of the object 6 from the Z direction perpendicular to the X-Y plane. Furthermore, the cutter 4 has a height that is set so that when the cutter holder 5 has been moved to a lowered position, the blade edge 4*c* passes through the object 6 on the holding sheet 10 but does not reach the upper surface of the plate member 3*b* of the platen 3, as shown in FIG. 8. On the other hand, the blade edge 4*c* of the cutter 4 is moved upward with movement of the cutter holder 5 to the raised position, thereby being departed from the object 6 (see. FIG. 5).

Three guide holes 52*b*, 52*c* and 52*d* (see FIGS. 3 to 5 and 9) are formed at regular intervals in a circumferential edge of the lower end of the cylindrical portion 52*a*. A pressing member 56 is disposed under the cylindrical portion 52*a* and has three guide bars 56*b*, 56*c* and 56*d* which are to be inserted into the guide holes 52*b* to 52*d* respectively. The pressing member 56 includes a lower part serving as a shallow bowl-shaped pressing portion body 56*a*. The aforementioned equally-spaced guide bars 56*b* to 56*d* are formed integrally on the circumferential end of the top of the pressing portion body 56*a*. The guide bars 56*b* to 56*d* are guided by the respective guide holes 52*b* to 52*d*, so that the pressing member 56 is vertically movable. The pressing portion body 56*a* has a central part formed with a through hole 56*e* which vertically extends to cause the blade 4*a* to protrude therethrough. The pressing portion body 56*a* has an underside serving as a contact 56*f* which is brought into contact with the object 6 while the blade 4*a* is located in the hole 56*e*. The contact 56*f* is formed into an annular horizontal flat surface and is brought into surface contact with the object 6. The contact 56*f* is made of a fluorine resin such as Teflon® so as to have a lower coefficient of friction, whereupon the contact 56*f* is adhesive with respect to the object 6.

The pressing portion body 56*a* has a guide 56*g* which is formed integrally on the circumferential edge thereof so as to extend forward, as shown in FIGS. 3 to 5 and 9. The guide 56*g* is located in front of and above the contact 56*f* and includes an inclined surface 56*ga* inclined rearwardly downward to the contact 56*f* side. Consequently, when the holding sheet 10 holding the object 6 is moved rearward relative to the cutter holder 5, the object 6 is guided downward by the guide 56*g* so as not to be caught by the contact 56*f*.

The mounting member 52 has a front mounting portion 52*e* for the solenoid 57, integrally formed therewith. The front mounting portion 52*e* is located in front of the cylindrical portion 52*a* and above the guide 56*g*. The solenoid 57 serves as an actuator for vertically moving the pressing member 56 thereby to press the object 6 and constitutes a pressing device 47 (a pressing unit) together with the pressing member 56 and a control circuit 61 which will be described later. The solenoid 57 is mounted on the front mounting portion 52*e* so as to be directed downward. The solenoid 57 includes a plunger 57*a* having a distal end fixed to the upper surface of the guide 56*g*. When the solenoid 57 is driven with the cutter holder 5 occupying the lowered position, the pressing member 56 is moved downward together with the plunger 57*a* thereby to press the object 6 at a predetermined pressure (see FIG. 9). On the other hand, when the plunger 57*a* is located above during non-drive of the solenoid 57, the pressing member releases the object 6 from application of the pressing force. When the cutter holder 5 is moved to the raised position during non-drive of the solenoid 57 (see two-dot chain line in FIG. 5), the pressing member 56 is completely departed from the object 6. A cutting unit 58 (see FIG. 1) is constituted by the above-described cutter 4, the first moving unit 7, the second moving unit 8, the third moving unit, the control circuit 61, the pressing device 47 and the like.

A plurality of types of holding sheets 10 is prepared according to types of objects 6. The wireless tag 60 is attached to each holding sheet 10. Information about the cutting is written in the wireless tag 60. Furthermore, a mark 59 is given to each holding sheet 10 in order that the user may discriminate the type of object 6 when viewing the mark 59. The holding sheet 10, the wireless tag 60 and the mark 59 will be described with reference to FIGS. 11A, 11B and 13. The holding sheet 10 is made of, for example, a synthetic resin and formed into a flat rectangular plate shape. The holding sheet 10 is placed opposite the cutter 4 and has a side (a top face) on which an adhesive layer 10*a* (see FIG. 8) is formed by applying an adhesive agent to the holding sheet 10 except for a peripheral edge including a left edge 10*b*, a right edge 10*c*, a rear edge 10*d* and a front edge 10*e* thereof.

The corresponding type of object 6 is attached to the adhesive layer of the holding sheet 10, whereby the object 6 is removably held by the holding sheet 10. The adhesive layer 10*a* has such an adhesion that the object 6 is immovably held while the object 6 is cut by the cutter 4. More specifically, when paper such as Kent paper or postcard as the object 6 is to be cut, a holding paper 10A (see FIG. 11A) with adhesion suitable to immovably hold the paper is selected. Furthermore, when a cloth as the object 6 is to be cut, the holding paper 10 according to a type of the cloth is used. For example, when felt as a type of cloth is to be cut, a holding paper 10B is used which has adhesion suitable to immovably hold the felt.

Additionally, when denim or broadcloth as the object 6 is to be cut, for example, a holding sheet 100 is used which has adhesion suitable to immovably hold the denim or a holding sheet 10D is used which has adhesion suitable to immovably hold the broadcloth. Thus, a plurality of types of holding papers 10 is prepared (see FIG. 13). In other words, paper and fabric differ from each other in material, and even the three types of fabrics, felt, denim and broadcloth differ from one another in the fabric quality such as fabric thickness or stretching properties. Accordingly, the adhesive layer 10*a* is set to the adhesion according to the properties of each object 6 and the adhesion which can prevent the object 6 from being broken when the object 6 is removed from the adhesion layer 10*a*. The aforementioned plural (for example, four) types of holding sheets 10A to 10D have an adhesion relationship shown as 10A<10B<10C<10D. Thus, the adhesion of the adhesive layer 10*a* is set to the aforementioned four values according to the types of the objects 6 respectively. It is of course needless to say that the types of the holding sheets 10 should not be limited to the above-described four types.

Figure 11B:
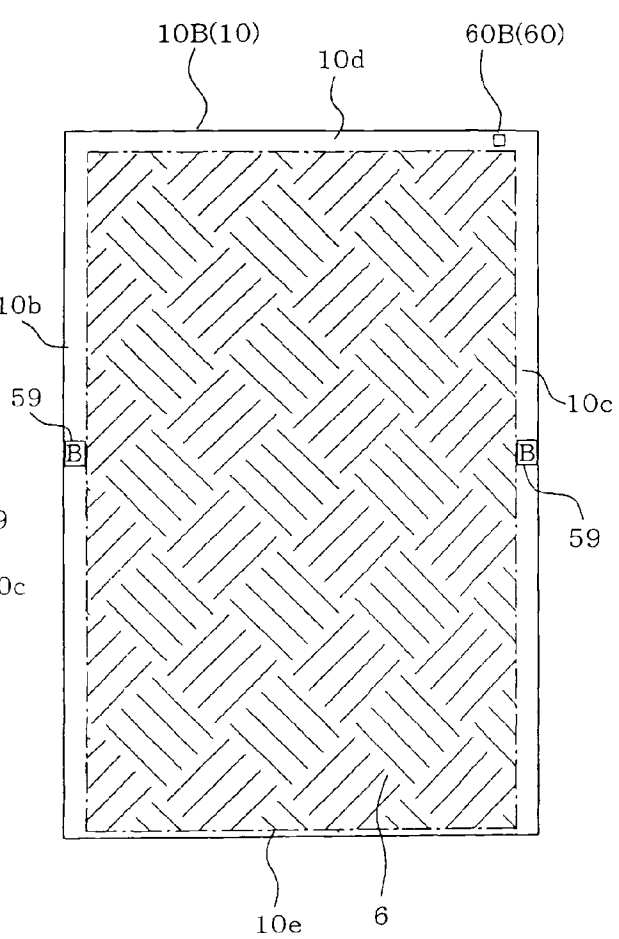
FIGS. 11A and 11B illustrate a plurality of types of holding members.
Figure 11A:
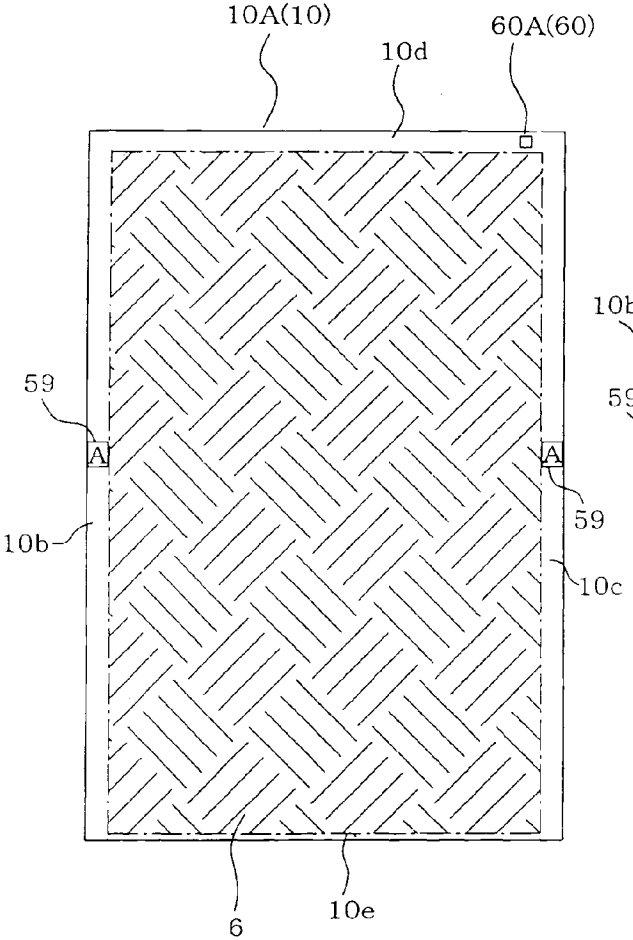
Figure 12:
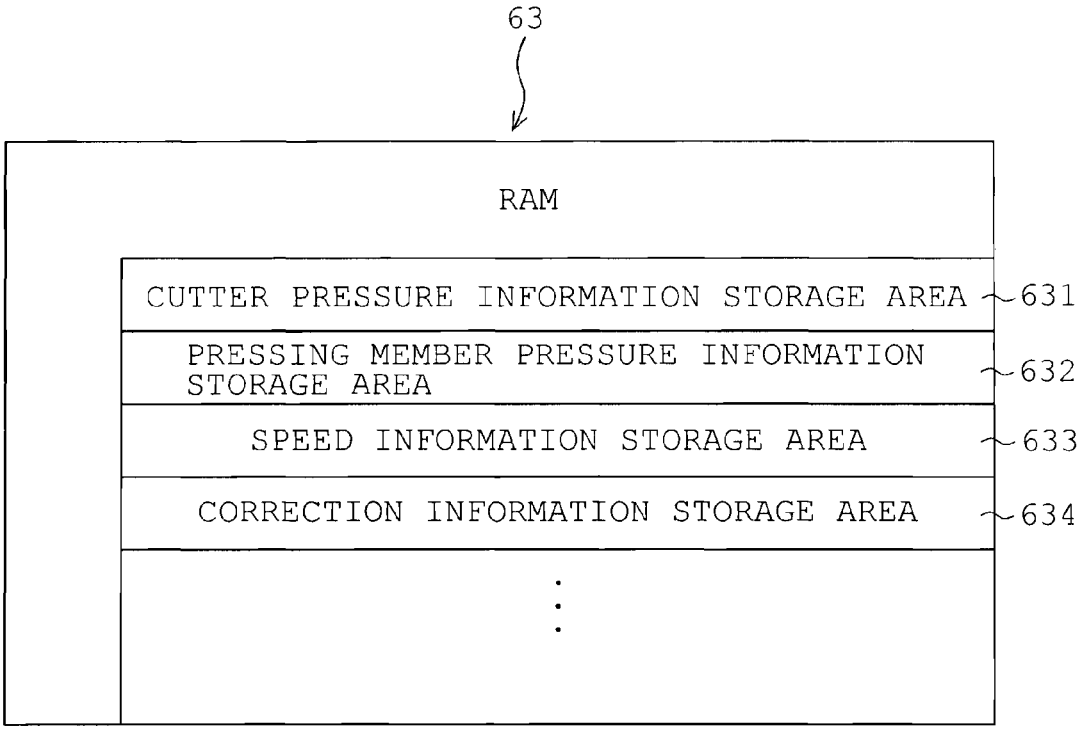
FIG. 12 is a conceptual diagram explaining, a storage region of RAM of the cutting apparatus.

The wireless tag 60 comprises an IC chip and a small antenna 71 (see FIG. 14A) as well known in the art and is provided on the rear edge 10*d* of the holding sheet 10, as will be described in detail later. The cutting information is written in the wireless tag 60 as described above. The wireless tag 60A is applied to a right top side (a surface) of the rear edge 10*d* of the holding sheet 10A by a double-sided adhesive tape (not shown) so as to be removable as shown in FIG. 11A. The wireless tag 60B is removably applied to a right top side of the rear edge 10D of the holding sheet 10B by the double-sided adhesive tape in the same manner as shown in FIG. 11B. Furthermore, the wireless tags 60C and 60D are removably applied to right top sides of the rear edges 10*d* of the holding sheets 10C and 10B by the double-sided adhesive tapes in the same manner as described above, as shown in FIGS. 11C and 11D, respectively. Different pieces of cutting information according to the holding sheets 10A-10D are written on the wireless tags 60A-60D respectively. The location of the wireless tag 60 to be applied to the holding sheet 10 should not be limited to the right top side of the rear edge 10*d*. The wireless tag 60 may be applied to another location on the holding sheet 10, instead.

The mark 59 will now be described. The mark 59 is provided for the user to discriminate the type of the holding sheet 10 by viewing the mark 59. Two marks 59 are affixed to generally middle positions of the left and right ends 10*b* and 10*c* of the holding sheet 10 respectively as shown in each of FIGS. 11A and 11B. In the embodiment, characters "A" and "B" serving as the marks 59 are printed on the holding sheets 10A and 10B respectively. Furthermore, corresponding characters are also printed on the holding sheets 10C and 10D in the same manner as described above, respectively, although not shown. The mark 59 may be a numeral, sign, pattern, figure, landmark, etc., instead of character. Furthermore, the location of the mark 59 should not be limited to those shown in FIGS. 11A and 11B, and the number of the marks 59 should not be limited to two. Still furthermore, different colors are given to the holding sheets 10 according to the sheet types. In this case, an entire holding sheet 10 may be colored or a part of the holding sheet 10 may be colored. Of course, both mark and color may be applied to each holding sheet 10. In the following description, the holding sheet 10A will be referred to as "paper holding sheet 10A," the holding sheet 10B as "felt holding sheet 10B," the holding sheet 100 as "denim holding sheet 10C" and the holding sheet 10D as "broadcloth holding sheet 10D."

Figure 10:
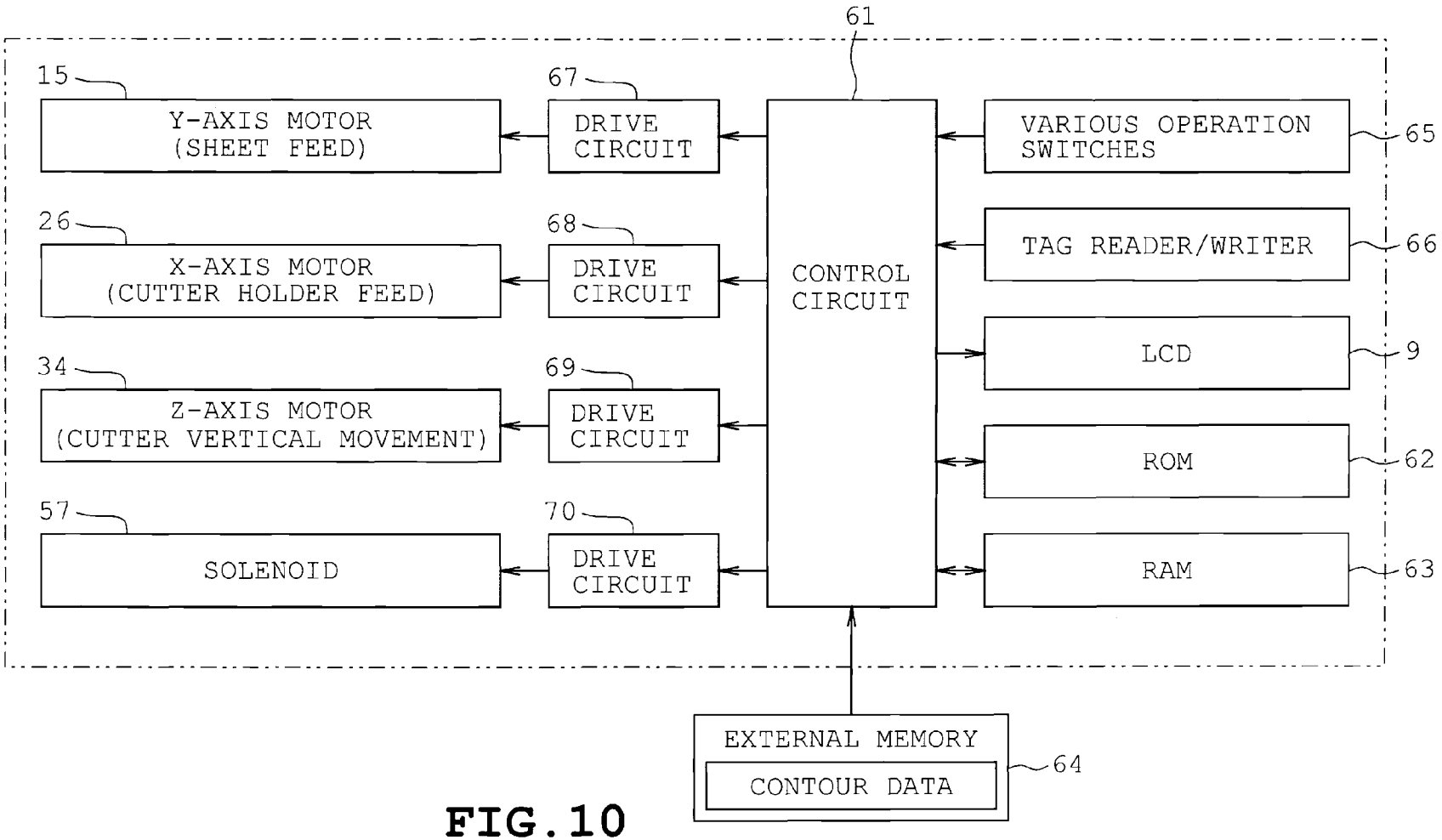
FIG. 10 is a block diagram showing an electrical arrangement of the cutting apparatus.

The configuration of control system for the cutting device 1 and the wireless tag 60 will be described with reference to FIGS. 10, 12, 14A and 14B. A control circuit (a control unit) 61 controlling the entire cutting apparatus 1 mainly comprises a computer (CPU) as shown in FIG. 10. A ROM 62, a RAM 63 and an external memory 64 each serving as a storage unit are connected to the control circuit 61. The ROM 62 stores a cutting control program for controlling the cutting operation and the like. The external memory 64 stores data of a plurality of types of contours used to cut a predetermined pattern contour.

The RAM 63 is provided with storage areas for temporarily storing various data. More specifically, the RAM 63 is provided with a plurality of storage areas including a cutter pressure information storing area 631 for storing data of pressing forces of the cutter 4 to be applied to the object 6, a pressing member pressure information storing area 632 for storing data of pressing force of the pressing member 56, a speed information storing area 633 for storing data of relative moving speed between the cutter 4 and the object 6 and a correction information storing area 634 for storing data of an amount of correction for correction of relative movement amount of the cutter 4 relative to the object 6. Data (cutting parameters) to be stored in the storage areas 631 to 634 will be described later.

To the control circuit 61 are connected drive circuits 67, 68, 69 and 70 driving the Y-axis motor 15, the X-axis motor 26, the Z-axis motor 34 and the solenoid 57 respectively. Upon execution of the cutting control program, the control circuit 61 controls the Y-axis motor 15, the X-axis motor 26, the Z-axis motor 34 and the solenoid 57 based on the above-described contour data and the cutting parameters, whereby the cutting operation is automatically executed for the object 6 on the holding sheet 10. Furthermore, to the control circuit 61 are connected the aforementioned various switches 65 which will hereinafter be referred to as "operation switches 65"), the tag reader/writer 66 and the LCD 9.

The tag reader/writer 66 has a function as a reading unit which executes wireless communication with the wireless tag 60 of the holding sheet 10 to read information in a non-contact manner and a function as a write unit which writes information in a non-contact manner. The tag reader/writer 66 includes a memory section a communication section and the like connected to a control section as a main section and an antenna for wireless communication. The control section is connected to the control circuit 61 and delivers a communication command to the communication section. As a result, the control section executes a transmission processing of transmitting from the antenna a wave signal with a predetermined frequency modulated using transmission information in the communication section and a receiving processing of demodulating original information from the wave signal received by the antenna.

The user operates the operation switches 65 while viewing the LCD 9, thereby executing input necessary for selecting contour data of a desired pattern contour. Furthermore, it is possible to display on the LCD 9 various information including information read from the wireless tag 60 by the tag reader/writer 65. The LCD 9 and the operation switches 65 serve as a setting unit which updates information read from the wireless tag 60, thereby being capable of setting cutting information including various parameters. A touch panel having a plurality of touch keys comprising transparent electrodes may be provided on the front of the LCD 9 so that various settings and inputs are executed based on input to the touch keys.

Figure 14A:
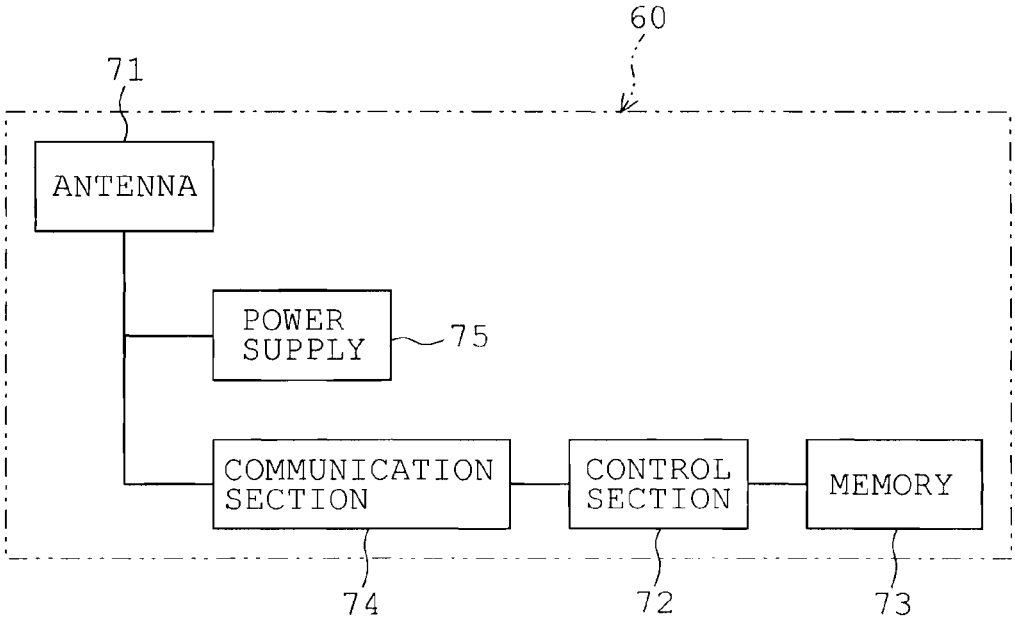
FIGS. 14A and 14B are a block diagram schematically showing an electrical arrangement of the wireless tag and a conceptual view explaining a storage region of the memory of the wireless tag, respectively.

The wireless tag 60 is provided with an IC chip and an antenna 71 as shown in FIG. 14A. The IC chip comprises a control section 72 as a main component, a memory 73 and a communication section 74 both connected to the control section 72, and a power supply 75 generating power supply voltage from radio waves received by the antenna 71. The power supply voltage obtained by the power supply 75 is consumed by the IC chip for operation. The communication section 74 executes processing of demodulating a data signal contained in radio waves received by the antenna 71 into an original data when the data signal is transmitted thereto. The control section 72 executes write of memory content of the memory 73 and the like according to the contents of a command from the tag reader/writer 66. The control section 72 further executes a control of the communication section 74 to transmit data stored on the memory 73 according to the contents of a command from the tag reader/writer 66, so that carrier waves in a predetermined frequency band are modulated by the data taken from the memory 73 to be transmitted from the antenna 71 to the tag reader/writer 66 side.

Figure 14B:
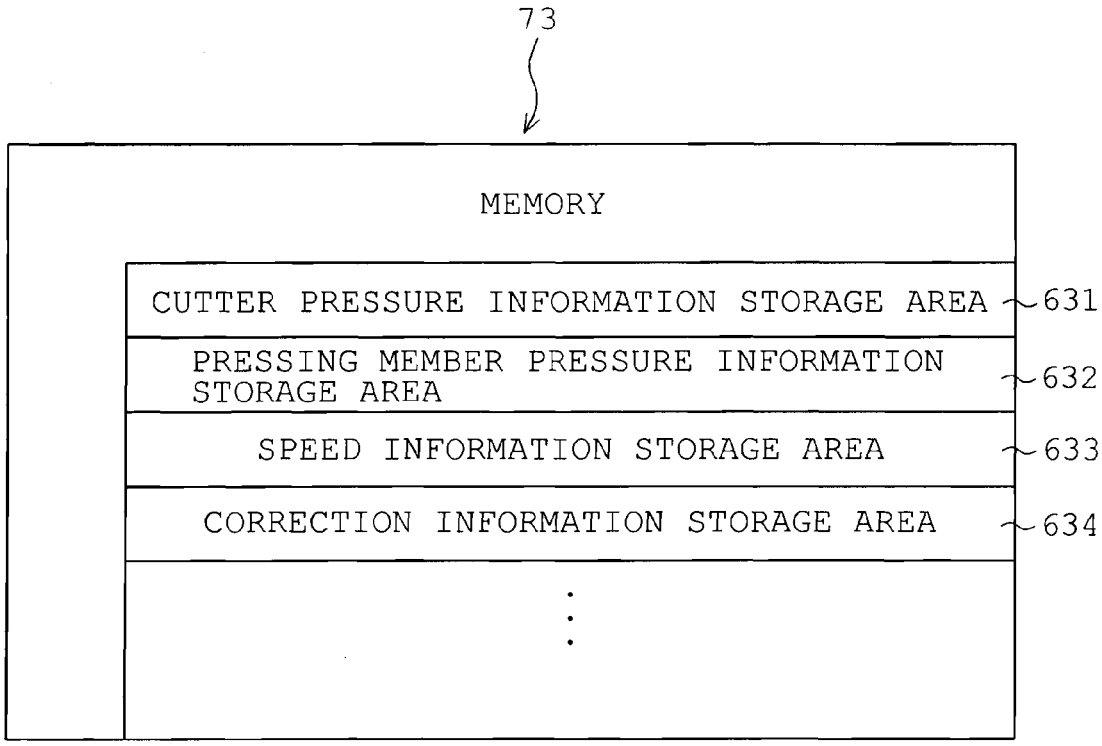

The memory 73 of the wireless tag 60 is provided with a plurality of storage areas including a cutter pressure information storage area 731, a pressing member pressure information storage area 732, a speed information storage area 733 and a collection information storage area 734 as shown in FIG. 14B. Cutter pressure data about pressure of the cutter 4 to be applied to the object 6 is written on the cutter pressure information storage area. The cutter pressure data is indicative of set values used to control a cutter pressure by adjusting a vertical position of the cutter 4 by the drive of the Z-axis motor 34 with the cutter holder 5 occupying the lowered position. Pressing member pressure data about pressure of the pressing member 56 is written on the pressing member pressure information storage area 732. The pressing member pressure data is indicative of a drive current of the solenoid 57 (a current value), and the pressure the pressing member 56 applies to the object 6 is controlled by the current value. Speed data about the relative moving speed between the cutter 4 and the object 6 is written on the speed information storage area 733. The speed data is indicative of set speeds of the Y-axis and X-axis motors 15 and 26. Correction data about an amount of correction to collect a relative movement amount of the cutter 4 is written on the compensation information storage area 734. The collection data is indicative of set values which is set according to an amount of stretch during the cutting of, the object 6 and used to collect drive amounts of the Y-axis and X-axis motors 15 and 26 so that occurrence of uncut part is prevented between a cutting start point and a cutting end point.

FIG. 13 exemplifies the aforementioned cutter pressure data, pressing member pressure data, speed data and correction data each of which is set according to the holding sheets 10A to 10D. Each data is individually set according to the aforementioned adhesion and properties of the object 6 so that an optimum cutting condition is achieved in the cutting apparatus 1 for every one of the holding sheets 10A-10*d*. More specifically, regarding the paper holding sheet 10A, the cutter pressure data, pressing member pressure data and speed data are set to low values respectively as shown on a first column of FIG. 13. Furthermore, since paper is non-stretchable, no collection for relative movement of the cutter 4 is carried out. Regarding the felt holding sheet 10B, the cutter pressure data and pressing member pressure data are set to intermediate values respectively, and the speed data is set to a high value. Since stretch of the felt is relatively larger, the correction data is set to a large value.

Regarding the denim holding sheet 10C, the cutter pressure data, pressing member pressure data and speed data are set to high values respectively. Since the stretch of denim is relatively smaller, the correction data is set to a relatively smaller value. Regarding the broadcloth holding sheet, the cutter pressure data is set to a low value, while the pressing member pressure data and the speed data are set to high values respectively. Since the stretch of broadcloth is intermediate, the correction data is set to an intermediate value. Thus, the memory areas 731 to 734 of the memories 73 of the wireless tags 60A to 60D store cutting parameters which are set so that optimum cutting conditions are achieved for the holding sheets 10A to 10D, respectively. The control circuit 61 reads the cutting parameters from the wireless tags 60A to 60D by the tag reader/writer 66 at the time of cutting start, controlling the cutting unit 58 based on the read data. The aforesaid cutting parameters serve as cutting information.

Figure 15:
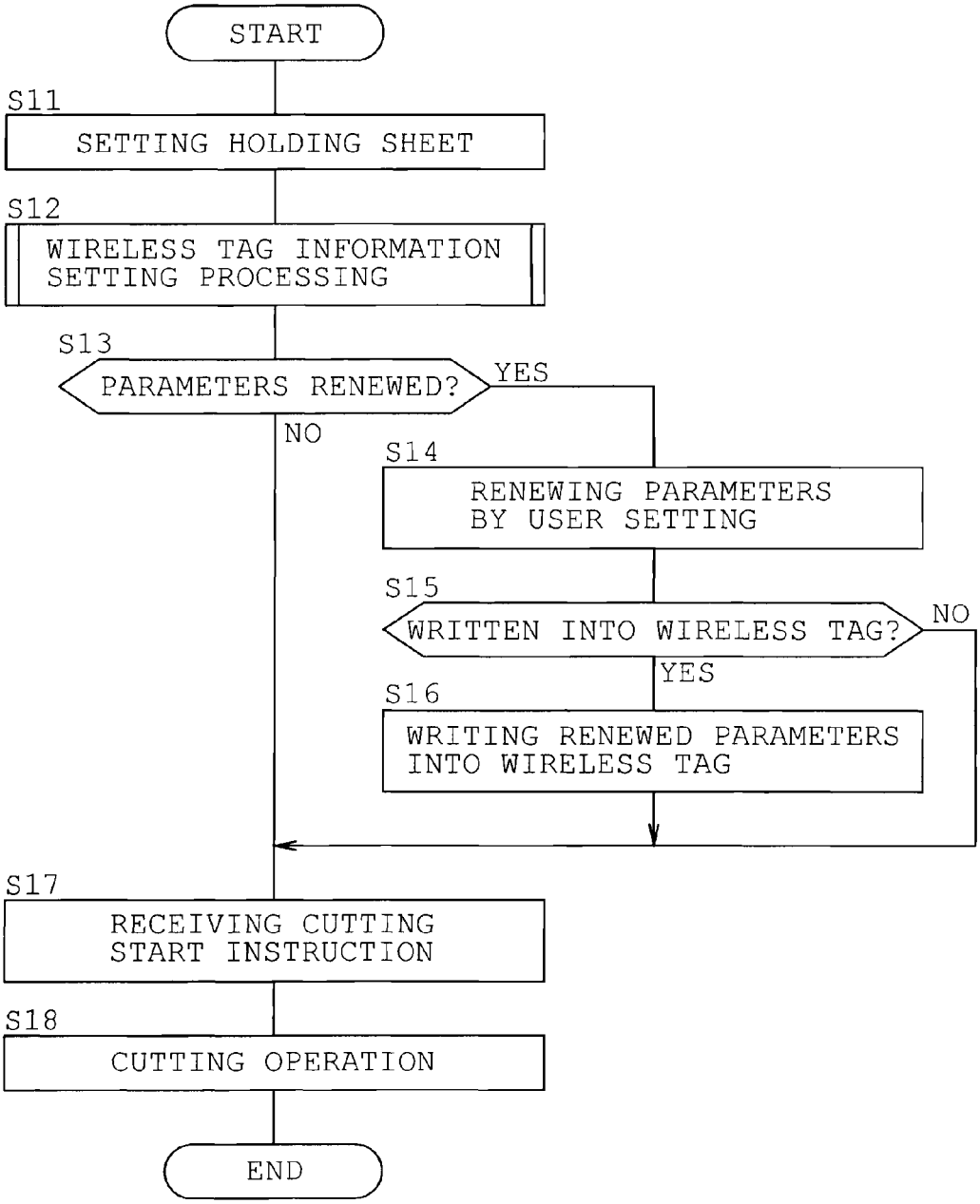
FIG. 15 is a flowchart showing an entire processing sequence in the case where cutting is executed based on the cutting parameters of the wireless tag.
Figure 16:
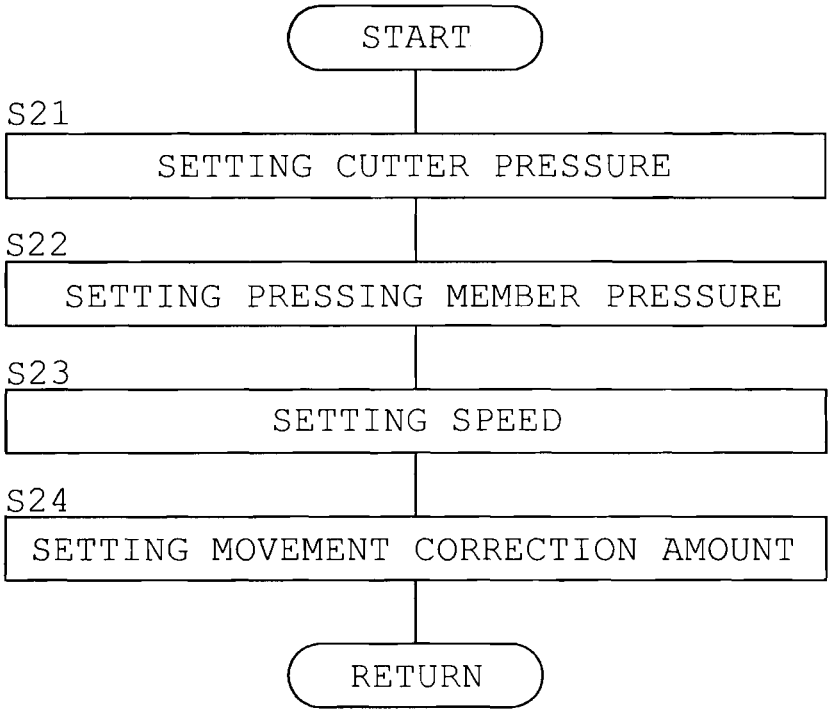
FIG. 16 is a flowchart showing processing sequence in the case where a cutting parameter of the wireless tag is read.

A concrete processing manner at the time of cutting start in the cutting apparatus 1 will be described with reference to FIGS. 15 and 16, which are flowcharts showing processing flows of programs executed by the control circuit 61 respectively. In the figures, a symbol Si (where i=11, 12, 13 and . . . ) designates each step.

The user prepares the object 6 and the holding sheet 10 corresponding to the type of the object 6 and applies the object 6 to the adhesive layer 10*a* of the holding sheet 10. The user then operates the operation switches 65 to select a desired contour data from the contour data stored in the external memory 64.

On the other hand, the cutter holder 5 occupies the raised position before start of the cutting of the object 6 in the cutting apparatus 1 (see FIG. 5). In this state, the user sets the holding sheet 10 holding the object 6 through the opening 2*a* of the cutting apparatus 1 (step S11). A wireless tag information setting processing is executed at step S12. In the wireless tag information setting processing, the aforementioned cutting parameters are read from the wireless tag 60 of the set holding sheet 10 thereby to be set as a cutting condition for the cutting apparatus 1 (see FIG. 16). More specifically, the control circuit 61 reads the cutter pressure data, pressing member pressure data, speed data and correction data to store, via the tag reader/writer 66, these pieces of data on the cutter pressure information storage area 631, the pressing member pressure information storage area 632, the speed information storage area 633 and the correction information storage area 634 respectively (steps S21 to S24).

Thus, the cutting parameters are automatically set in the cutting apparatus 1 based on the data stored on the wireless tag 6Q through steps S21 to S24. For example, when the felt holding sheet 10B to which felt is applied as the object 6 has been set at step S11, the cutter pressure data and the pressing member pressure data are set to INTERMEDIATEs respectively. The speed data is set to HIGH and the correction data is set to LARGE (see FIG. 13). The wireless tag information setting processing is herewith completed (returning to step S13 in FIG. 15).

The control circuit 61 subsequently displays on the LCD 9 the cutter pressure data, pressing member pressure data, speed data and correction data set at step S12 together with a message as to whether or not the cutting parameters are to be updated. The user then operates the operation switches 65 to instruct update of the cutting parameters (YES at step S13), whereupon the cutting parameters stored on the RAM 63 can be updated into desired values (step S14). In this case, the user operates the operation switches 65 to set the cutting parameters to the respective values displayed on the LCD 9 anew. The set data is overwritten on the storage areas 631 to 634 of the RAM 63. Although the object 6 to be actually cut is felt in this case, the cutting time period can be shortened by updating the speed data into a slightly higher value when the felt has a relatively smaller thickness. Furthermore, a more accurate cutting can be executed when the cutter pressure data, pressing member pressure data, speed data and the correction data are suitably changed and updated according to the material properties (degree of surface irregularities (smoothness), thickness, etc.).

Furthermore, the control circuit 61 displays on the LCD 9 a message as to whether or not the cutting parameters updated at step S14 should be written onto the wireless tag 60. The user may operate the operation switches 65 to instruct the write onto the wireless tag 60 (YES at step S15). Upon receipt of the instruction to write onto the wireless tag 60, the control circuit 61 writes (overwrites), via the tag reader/writer 66, updated cutter pressure data, pressing member pressure data, speed data and correction data onto the cutter pressure information storage area 731, pressing member pressure information storage area 732, speed information storage area 733 and correction information storage area 734 respectively (step S16). When the user has not instructed update or write of the cutting parameters (NO at step S13 or S15), the aforementioned update of data stored on the RAM 734 and write of data onto the wireless tag 60 are not carried out. In this case, the wireless tag 60 may be provided with a second memory which is separate from the memory section 73 and onto which are written the updated cutter pressure data, pressing member pressure data, speed data and correction data. The memory section 73 is read-only, although the second memory is not shown. When the updated cutter pressure data, pressing member pressure data, speed data and correction data are desired to be returned to respective initial values, the initial values are read from the memory 73.

When the operation switches 65 are operated with the cutting parameters having been set in the cutting apparatus 1, the control circuit 61 starts the cutting operation based on the operation signals (step S17). While referring to the cutter pressure information storage area 631, pressing member pressure information storage area 632, speed information storage area 633 and correction information storage area 634, the control circuit 61 then controls the cutting unit 58 based on cutter pressure data, pressing member pressure data, speed data and correction data stored on the storage areas 631 to 634 respectively (step S18).

More specifically, in order that the blade edge of the cutter 4 may be moved to the cutting start point of the object 6, the control circuit 61 firstly controls the Y-axis motor 15 and the X-axis motor 26 so that the cutter 4 and the object 6 are moved relative to each other. The control circuit 61 controls the drive of the Y-axis and X-axis motors based on the pressing member pressure data while the cutter 4 occupies the cutting start point, so that the object 6 is pressed by the pressing member 56. Furthermore, the control circuit 61 controls the drive of the Z-axis motor 34 based on the cutter pressing data, so that the cutter holder 5 is moved to the lowered position and the blade edge 4C of the cutter 4 is passed through the cutting start point of the object 6. The control circuit 61 then drives the Y-axis motor 15 and the X-axis motor 26 based on the contour data and speed data, so that the cutter 4 and the object 6 are moved relative to each other thereby to cut the object 6.

The cutter 4 is subjected to a resisting force from the object 6 with the relative movement of the cutter 4 during the cutting. However, the holding sheet 10 is used which is optimal for holding the object 6, and the contact portion 56*f* applies a suitable pressure to the object 6, based on the pressing member pressure data. Consequently, the object 6 is reliably held by the adhesion of the adhesive layer 10*a* of the holding sheet 10 and the pressing member pressure of the contact portion 56*f* so as not to be moved relative to the holding sheet 10. In relation to the pressing member pressure, the motors 15 and 26 can be controlled so as not to lose steps, whereupon a continuous stable cutting can be performed. Furthermore, the object 6 can reliably be cut since the Z-axis motor 34 is controlled on the basis of the cutter pressure data. The cutter 4 is caused to do extra movement on the basis of the correction data in order that expansion and contraction of the object 6 may be coped with at the end of cutting, so that occurrence of uncut part is prevented between the cutting start point and the cutting end point.

Upon end of cutting of the object 6, the user removes the object 6 from the holding sheet 10. In this case, since the adhesive layer 10*a* of the holding sheet 10 has the adhesion set according to the object 6, the object 6 can easily be removed.

The holding sheet can be used repeatedly to some extent. However, the adhesion of the adhesive layer 10*a* is gradually reduced such that the adhesive layer 10*a* becomes unusable, as the number of times of use of the holding sheet 10 is increased, since the object 6 is applied to and removed from the holding sheet 10 alternately repeatedly. In view of this problem, when the holding sheet 10 which has become unusable is replaced by a new one, the user removes the wireless tag 60A affixed to the holding sheet 10 by the double-sided adhesive tape. The user then affixes the wireless tag 60 to a new holding sheet 10 which has the same adhesion as the previous one. Thus, the holding sheet 10 is greatly convenient since the new holding sheet 10 can be used as the holding sheet 10A immediately after the affixing of the wireless tag 60 thereto. Furthermore, when the wireless tag 60 which has been used for one holding sheet is desired to be affixed to another holding sheet, for example, namely, when the wireless tag 60A is desired to be used as the wireless tag 60B, the value of cutting parameter is updated to a new value suitable for the holding sheet 10B thereby to be written (overwritten), whereupon the wireless tag 60A can be used as the wireless tag 60B.

The above-described steps S12 and S21 to S24 serve as a reading routine for reading the cutting information from the wireless tag 60 by the reading unit when the holding sheet 10 has been set on the cutting apparatus 1. Step 18 serves as a cutting control routine for controlling the cutting unit 58 based on the cutting information read from the wireless tag 60 in the reading routine.

Furthermore, steps S13 and 14 serve as a setting routine for setting for updating cutting information read from the wireless tag 60 in the reading routine. Steps S15 and S16 serve as a writing routine for writing the cutting information updated in the setting routine into the wireless tag 60.

The control circuit 61 of the cutting apparatus 1 serves as a control unit and controls the cutting unit 58 based on the cutting information (cutting parameters) read from the wireless tag 60 in the reading routine. The cutting information is read from the wireless tag 60 of the holding sheet 10 set on the cutting apparatus 1, and the operation of the cutting unit 58 is controlled on the basis of the cutting information by the control circuit 61. Accordingly, the object 6 can accurately be cut since the object 6 is prevented from displacement from the holding sheet 10 during the cutting operation without reliable holding of the object 6.

The cutting information includes at least one of the relative movement speed between the cutter 4 and the object 6, the pressure of the cutter 4 against the object 6 and the correction amount for correcting the relative movement speed of the cutter 4 relative to the object 6. Accordingly, the control circuit 61 controls the cutting unit 58 properly, based on at least one of these pieces of information, whereupon the object 6 can reliably be cut. Furthermore, the usability of the cutting apparatus 1 can be improved since the user need not enter the cutting information into the cutting apparatus 1.

The cutting unit 58 is provided with the pressing device 47 which presses the object 6 held by the holding sheet 10, and the cutting information includes a pressing force of the pressing device 47. As a result, the object 6 held by the holding sheet 10 can be pressed by the pressing device 47. Furthermore, since the pressing force is settable for every holding sheet 10, the object 6 can more reliably be held so as not to displace from the holding sheet 10 during the cutting operation.

The LCD 9 and the operation switches 65 serve as a setting unit and update the cutting data read from the wireless tag 60 by the tag reader/writer 66. The tag reader/writer 66 serves as a writing unit which writes the cutting information updated in the setting routine onto the wireless tag 60. As a result, the cutting operation can be carried out while the cutting information is updated according to the material property of the object 6 to actually be cut. Furthermore, since the updated cutting information is written into the wireless tag 60, the object can reliably be cut on the basis of the updated cutting information also in subsequent cutting.

The wireless tag 60 is detachably attached to the holding sheet 10. Consequently, the wireless tag 60 can be used repeatedly by attaching it to a new or another holding sheet 10.

FIGS. 17 to 21 illustrate a second embodiment. Only the difference between the first and second embodiments will be described. Identical or similar parts in the second embodiment are labeled by the same reference symbols as those in the first embodiment.

In the second embodiment, the wireless tag 60, has a memory 73 provided with a contour data memory area 735, a cutting sequence data memory area 736 and a layout data memory area 737. Contour data for cutting a predetermined pattern contour is written in the contour data memory area 735. On the cutting sequence data memory area 736 is written cutting sequence data which specifies a cutting sequence in the case where a plurality of pattern contours are to be cut from the object 6. Layout data which specifies a layout position of pattern contour on the object 6 is written on the layout data memory area 737.

Figure 18A:
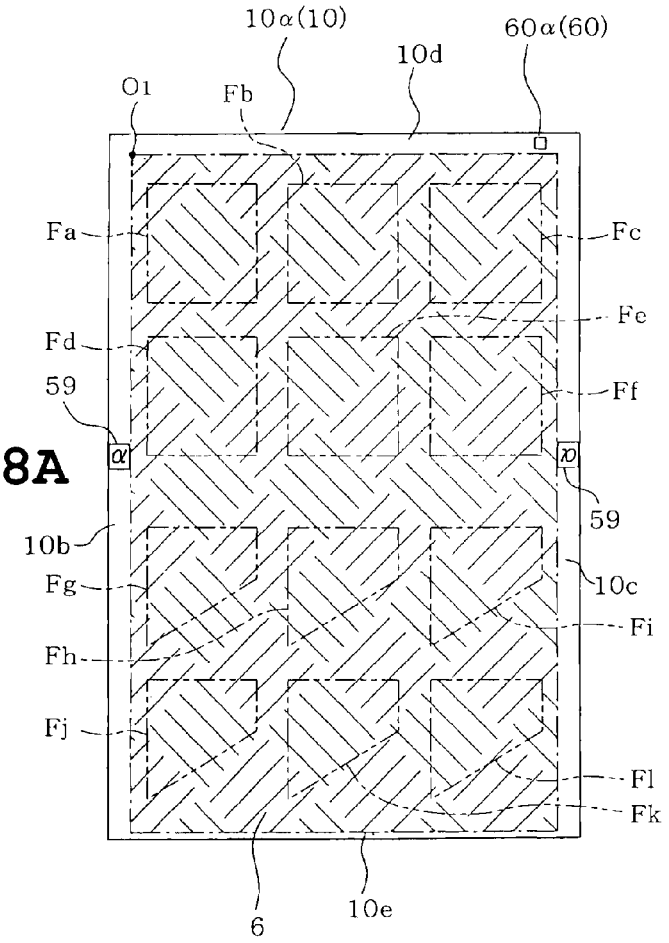
FIGS. 18A, 18B and 18C are a view similar to FIG. 11A, showing the pattern contour to be cut based on contour data, an enlarged square pattern contour and an enlarged trapezoidal pattern contour, respectively.

The contour data will now be described with a case where a plurality of pattern contours (12, for example) is cut from the object 6 held by the holding sheet 10. Six square pattern contours $F_a$ to $F_f$ and six trapezoidal pattern contours $F_g$ to $F_l$ are to be cut as shown in FIG. 18A. Full coverage data in this case includes the number of patterns as information of the total number of pattern contours $F_a$ to $F_l$, contour data of pattern contours $F_a$ to $F_l$, contour separation data and the like as shown in FIG. 19. The cutting sequence data stored so as to correspond to the pattern contours $F_a$ to $F_l$ (see cuttings 1 to 12 in FIG. 19). The number of patterns is 12, and contour data of each one of the pattern contours $F_a$ to $F_l$ comprises coordinate data of X-Y coordinates indicative of apexes of cutting lines including a plurality of line segments.

More specifically, the cutting line of pattern contour $F_a$ includes four line segments $a_1$ to $a_4$ and is formed into a closed square in which a cutting start point $P_0$ and a cutting end point $P_4$ correspond with each other. Contour data of the pattern contour $F_a$ includes first to fifth coordinate data corresponding to the cutting start point $P_0$, apex $P_1$, apex $P_2$ apex $P_3$ and cutting end point $P_4$ respectively (see FIG. 19). Each of the pattern contours $F_b$ to $F_f$ has the same square shape as the pattern contour $F_a$ and the cutting line including the same four line segments as the pattern contour $F_a$, as shown in FIG. 18A. Furthermore, the pattern contours $F_b$ to Ff have coordinate values (first to fifth coordinate data) that are set so that the pattern contours $F_a$ to $F_f$ are formed separately from one another.

Figure 18B:
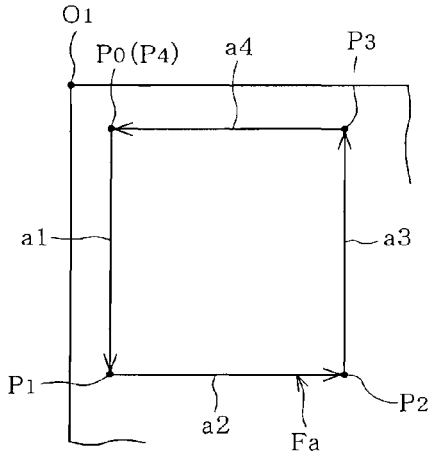
Figure 18C:
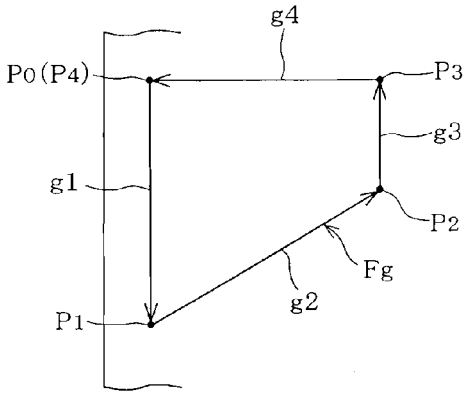

The pattern contour $F_g$ has a cutting line including four line segments $g_1$ to $g_4$ and is formed into a closed trapezoidal contour in which the cutting start point $P_0$ and the cutting end point $P_4$ correspond with each other, as shown in FIG. 18C. The trapezoidal contour includes two apexes $P_0$ and $P_3$ at each of which line segments make an angle of 90° and first to fifth coordinate data which serve as contour data of pattern contour $F_g$ and correspond to cutting start point $P_0$, apex $P_1$, apex $P_2$, apex $P_3$ and cutting end point $P_4$ respectively. The other pattern contours $F_h$ to $F_l$ are each trapezoidal in the same manner as the pattern contour $F_g$ and composed of the same four line segments as the pattern contour $F_g$. Furthermore, the coordinate values of the pattern contours $F_h$ to $F_l$ are set so that the pattern contours $F_g$ to $F_l$ are separated from one another.

The character "α" is printed on the holding sheet $\mathbf{10}_\alpha$ as a mark 59 which is used for the user to discriminate the above-described pattern contour set for every holding sheet 10. The mark 59 is arbitrarily changeable as described in the first embodiment.

For example, the entire object 6 or an overall region of the adhesive layer 10*a* may serve as a region where the pattern contours can be cut. The aforementioned layout data includes origin data that is region data indicative of a cut-allowable region and is set on the basis of the size of the adhesive layer 10*a* (holding sheet 10). More specifically, point $O_1$ is assumed as a corner in a cut-allowable region (a corner of the object 6 in FIG. 18A), for example. The cutting apparatus 1 includes a detector (not shown) which detects a set holding sheet 10*a* through the opening 2*a*. Point $O_1$ on the set holding sheet $\mathbf{10}_\alpha$ is set as an origin $(X_0, Y_0)$ on the basis of a detection signal of the detector and the aforementioned origin data. The aforementioned contour data and region data are defined by a coordinate system of the cutting apparatus 1 having as a reference point the origin $O_1$ of the holding sheet $\mathbf{10}_\alpha$. The control circuit 61 determines layout positions of pattern contours $F_a$ to $F_l$ within the cut-allowable region, based on the contour data and the region data. In the coordinate system of the cutting apparatus 1, the left-to-right direction with respect to the holding sheet $\mathbf{10}_\alpha$ is referred to as "X-axis positive direction" and the back-to-front direction with respect to the holding sheet $\mathbf{10}_\alpha$ (that is, the direction in which the holding sheet 10α is moved rearward) is referred to as "Y-axis positive direction."

Figure 17:
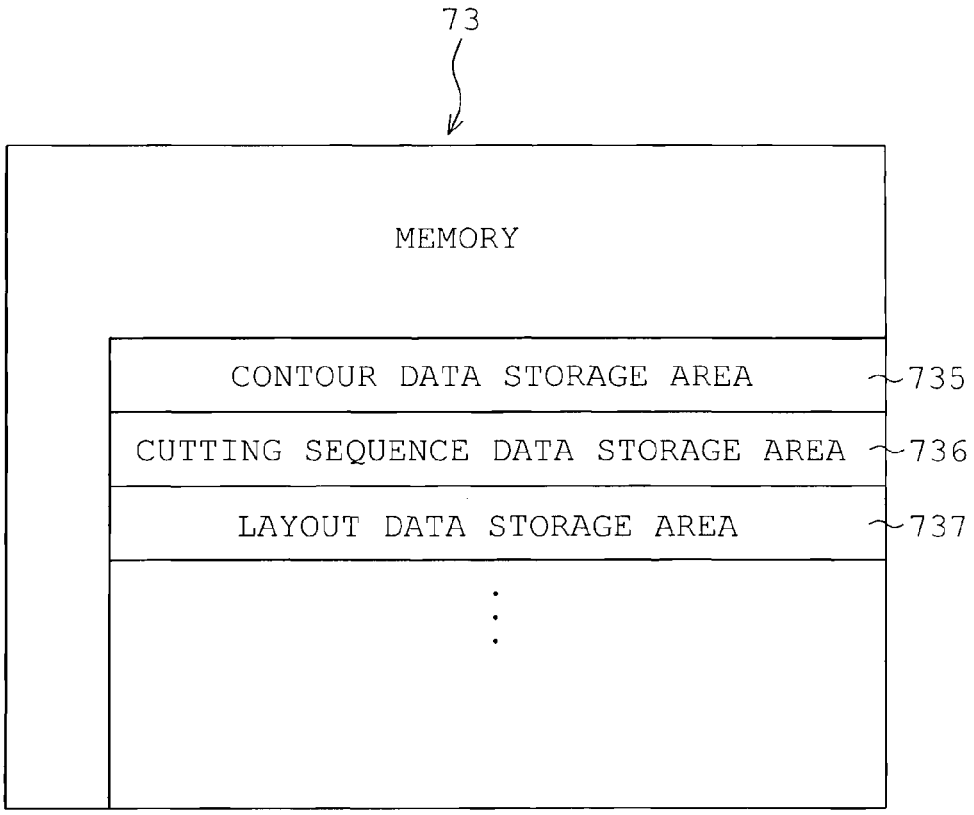
FIG. 17 is a view similar to FIG. 14B, showing a second embodiment.
Figure 20:
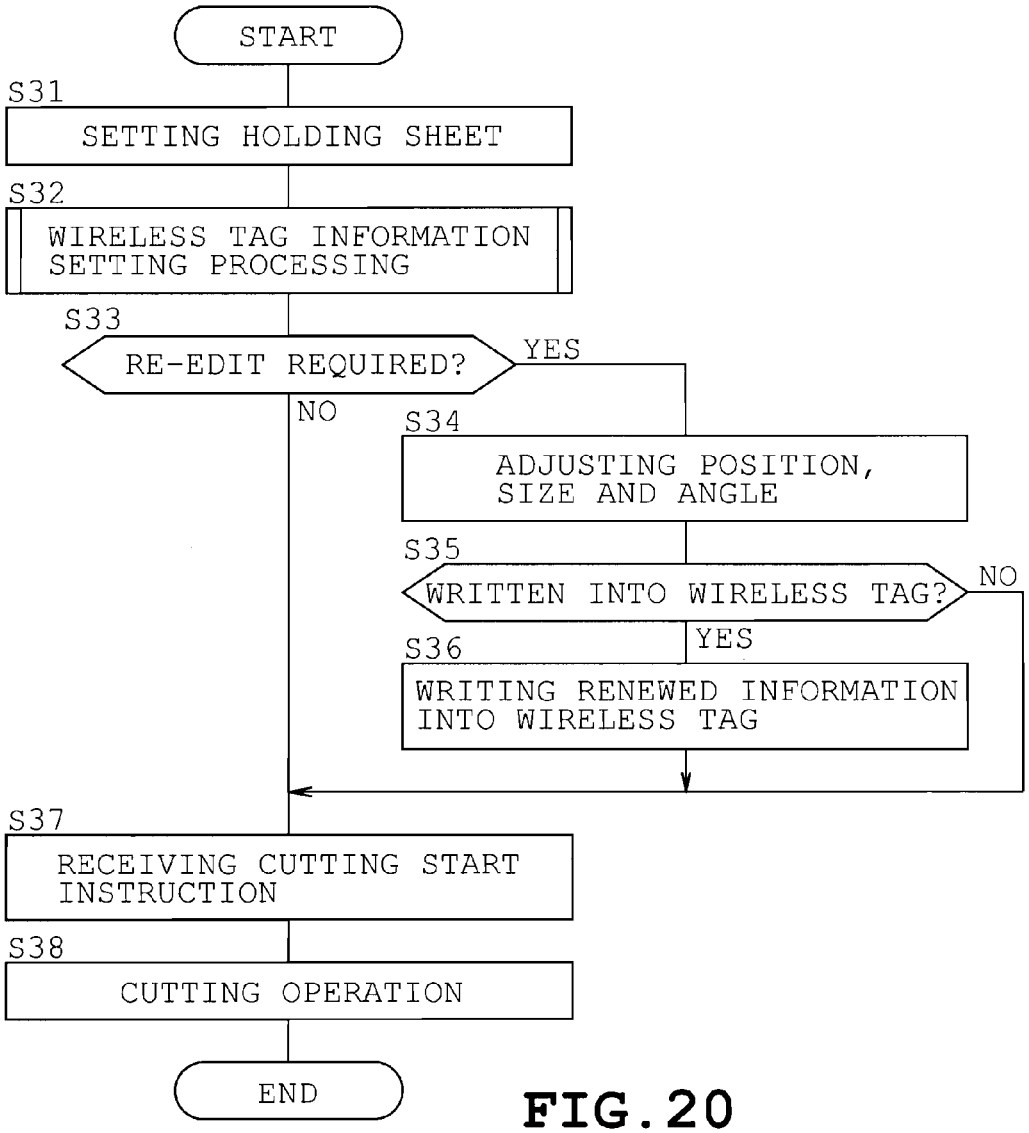
FIG. 20 is a view similar to FIG. 15, showing the case where cutting is executed based on cutting information about contour data of the wireless tag.
Figure 21:
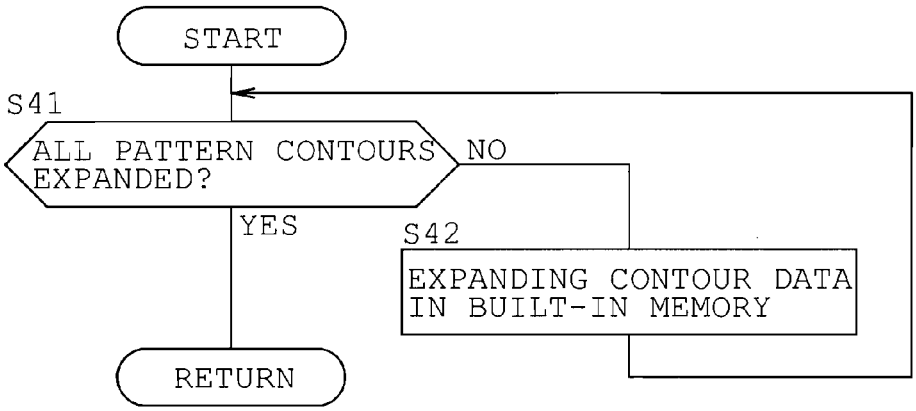
FIG. 21 is a view similar to FIG. 16.

The following describes a concrete processing procedure in the case where the object 6 is cut using the above-described holding sheet 10*a* with reference to FIGS. 20 and 21 as well as FIGS. 17 to 19. When cutting the pattern contours $F_a$ to $F_l$, the user prepares a holding sheet 10, corresponding to the contours and affixes the object 6 onto the adhesive layer 10*a* of the holding sheet $\mathbf{10}_\alpha$. The user then sets the holding sheet $\mathbf{10}_\alpha$ holding the object 6 onto the cutting apparatus 1 through the opening 2*a* (step S31). As a result, information setting processing is executed with respect to the wireless tag $\mathbf{60}_\alpha$ of the set holding sheet $\mathbf{10}_\alpha$ at step S32 (see FIG. 21).

More specifically, the control circuit 61 controls the tag reader/writer $\mathbf{60}_\alpha$ to read full coverage data, cutting sequence data and layout data all stored on the memory 73 of the wireless tag $\mathbf{60}_\alpha$, storing the read data on the RAM 63 (step S42). Regarding the full coverage data, when contour data of all the pattern contours $F_a$ to $F_l$ is loaded into the memory area of the RAM 63 (YES at step S41), the pattern contour to be cut by the cutting apparatus 1 is automatically set on the basis of the full coverage data stored on the wireless tag $\mathbf{60}_\alpha$. In this case, furthermore, the control circuit 61 sets the corner of the cut-allowable region as the origin $O_1$ as described above and sets layout positions of the pattern contours $F_a$ to $F_l$ according to the cut-allowable region, based on the region data and the full coverage data (see FIG. 18A), ending the wireless tag information setting processing (returning to step S33 in FIG. 20).

Subsequently, the control circuit 61 displays, on the LCD 9, the pattern contours $F_a$ to $F_l$ which are arranged so as to correspond to the cut-allowable region at step S32 and a message as to whether or not the layout of the pattern contours $F_a$ to $F_l$ and/or the like is edited. The user then operates the operation switches 65 to instruct edit of the pattern contours $F_a$ to $F_l$ (YES at step S33), whereby the user can update the full coverage data, the cutting sequence data and the layout data all stored in the RAM 63 into desired data respectively (step S34). For example, the user operates the operation switches 65 to carry out repositioning, expansion and contraction regarding the pattern contours $F_a$ to $F_l$ in the cut-allowable region displayed on the LCD 9 or to turn the pattern contours $F_a$ to $F_l$ about the center of the cut-allowable region. In this case, the user may enter the values of amounts of movement, scale factors and angles of all pattern contours $F_a$ to $F_l$ so that respective coordinate values are computed by the control circuit 61, or coordinate values of pattern contours $F_a$ to $F_l$ may directly be entered. As a result, the layout is changed so that the pattern contours $F_a$ to $F_l$ are tightly arranged, whereupon the yield of the object 6 can be improved and the pattern contours $F_a$ to $F_l$ can be changed into respective desired sizes. The edited full coverage data is overwritten on the storage region of the RAM 63, whereby the previous full coverage data is updated. Furthermore, when the operation switches 65 are operated, origin data contained in the layout data and the cutting sequence data are updated, whereby the layout and cutting sequence of the pattern contours $F_a$ to $F_l$ can be changed suitably.

Furthermore, the control circuit 61 displays on the LCD 9 a message as to whether or not the data updated at step S34 should be written into the wireless tag $\mathbf{60}_\alpha$. The user can instruct to write the updated data into the wireless tag $\mathbf{60}_\alpha$ by operation of the operation switches 65 (YES at step S35). Upon receipt of an instruction of writing data, the control circuit 61 writes updated full coverage data, cutting sequence data and layout data into the contour data storage area 735, the cutting sequence data storage area 736 and the layout data storage area 737 of the wireless tag $\mathbf{60}_\alpha$ respectively (step S36). When there is no instruction about data update or data write by the user (NO at step S33 or S35), the above-described update of data stored in the RAM 63 or data write into the wireless tag $\mathbf{60}_\alpha$ is not executed. Furthermore, a second memory other than the memory 73 may be provided in the wireless tag $\mathbf{60}_\alpha$ so that the updated full coverage data, cutting sequence data and layout data are written into the second memory.

When the operation switches 65 are operated while the data on the pattern contours $F_a$ to $F_l$ to be cut by the cutting apparatus 1 have been set, the control circuit 61 starts a cutting operation based on the operation signal (step S37). The control circuit 61 refers to the memory areas of the RAM 63 thereby to control the cutting unit 58 based on the full coverage data, cutting sequence data and layout data stored in the respective memory areas (step S38).

More specifically, regarding the pattern contours $F_a$ to $F_l$ whose layout positions are specified with the right upper corner serving as the origin $O_1$ in the cut-allowable region, the control circuit 61 sequentially executes a cutting operation based on the contour data and the cutting sequence data (see FIGS. 18A to 18C and 19). The first moving unit 7 is firstly drive to move the holding sheet $\mathbf{10}_\alpha$ (the object 6) in the Y direction, and the second moving unit 8 is driven to move the cutter holder 5 in the X direction, so that the cutter 4 is relatively moved to the X-Y coordinate of the cutting start point $P_0$ of the pattern contour $F_a$. The third moving unit 44 is then driven to cause the blade edge of the cutter 4 to pass through the cutting start point $P_0$ of the object 6, and the first and second moving units 7 and 8 are driven to relatively move the blade edge toward the coordinate of the end point $P_1$ of line segment $a_1$, whereby the object 6 is cut along the line segment $a_1$. Regarding the next line segment $a_2$, the same cutting operation as applied to the line segment $a_1$ is continuously executed with the end point $P_1$ of the previous line segment $a_l$ serving as a start point. Regarding the line segments $a_2$ to $a_4$, too, the cutter 4 is relatively moved to the directions as shown by respective arrows in FIG. 18B so that pattern contours $F_a$ are cut or the cutting operation is carried out along the square cutting line. Furthermore, regarding pattern contours $F_b$ to $F_f$, the cutting operation is carried out along cutting lines of pattern contours $F_b$ to $F_f$ on the basis of the respective contour data in the same manner as described above.

Furthermore, the cutter 4 is relatively moved in the directions as shown by respective arrows in FIG. 18B with the cutting start point $P_0$ so that the cutting operation is executed along trapezoidal cutting lines of line segments $g_1$ to $g_4$. Furthermore, regarding pattern contours $F_h$ to $F_l$, the cutting operation is also carried out along cutting lines of pattern contours $F_h$ to $F_l$ on the basis of the respective contour data in the same manner as described above. Thus, the pattern contours $F_a$ to $F_c$, $F_d$ to $F_f$, $F_g$ to $F_i$ and $F_j$ to $F_l$ are efficiently cut sequentially from the top pattern contours $F_a$ to $F_c$ to the lower ones on the basis of respective contour data in the same manner as described above.

Upon completion of the cutting of the objects 6, the user removes the object 6 from the holding sheet 10. When continuously cutting the pattern contours $F_a$ to $F_l$ by the use of the cutting apparatus 1, the user sets the holding sheet to which a new object 6 is affixed to the cutting apparatus 1. In this case, the pattern contours $F_a$ to $F_l$ are automatically set in the cutting apparatus 1 on the basis of the full coverage data stored in the wireless tag $\mathbf{60}_\alpha$. Accordingly, the user can omit selection of pattern contours $F_a$ to $F_l$, editing layout, size and the like. Thus, the same pattern contours $F_a$ to $F_l$ can be cut every time when the holding sheet $\mathbf{10}_\alpha$ is used in the cutting apparatus 1.

The pattern contour should not be limited to the above-described pattern contours $F_a$ to $F_l$. Data of various pattern contours may be stored in the wireless tag 60 for every holding sheet 10 and may selectively be used according to the pattern contour to be cut. Regarding the holding sheet $\mathbf{10}_\alpha$ having the adhesive layer 10*a* whose adhesion has been gradually reduced, the wireless tag $\mathbf{60}_\alpha$ is removed from the holding sheet $\mathbf{10}_\alpha$ and affixed to a new holding sheet 10 in the same manner as in the first embodiment. As a result, the new holding sheet 10 can be used as the holding sheet $\mathbf{10}_\alpha$ at once.

The steps S32 and s41 and s42 serve as a reading routine and step S38 serves as a cutting control routine. Furthermore, steps S33 and S34 serve as a setting routine and steps S35 and S36 serve as writing routine.

As described above, the cutting information including the contour data used to cut the predetermined pattern contours $F_a$ to $F_l$ is written in the wireless tag $\mathbf{60}_\alpha$. The pattern contours $F_a$ to $F_l$ are cut on the basis of the contour data read from the wireless tag $\mathbf{60}_\alpha$. Accordingly, entry of the contour data into the cutting apparatus and the setting of the contour data in the cutting apparatus can be eliminated. Furthermore, since the same pattern contours are repeatedly cut for every holding sheet 10, the usability of the cutting apparatus can be improved.

The cutting information including the layout data used to lay out the pattern contours $F_a$ to $F_l$ on the object 6 is written in the wireless tag $\mathbf{60}_\alpha$. The layout of the patterns contours $F_a$ to $F_l$ on the object 6 is determined on the basis of the layout data read from the wireless tag $\mathbf{60}_\alpha$. Accordingly, the pattern contours $F_a$ to $F_l$ can be cut within the cut-allowable region according to the size of the object 6 without entry of layout data into the cutting apparatus 1.

The cutting information including the cutting sequence data to specify the cutting sequence of the plural pattern contours $F_a$ to $F_l$ is written in the wireless tag $\mathbf{60}_\alpha$. Since the cutting sequence of the plural pattern contours $F_a$ to $F_l$ is specified on the basis of the cutting sequence data read from the wireless tag $\mathbf{60}_\alpha$, entry of the cutting information into the cutting apparatus 1 can be omitted. In particular, in the case where mutual positions of the pattern contours $F_a$ to $F_l$ have been changed, the cutting time can be reduced when the cutting sequence is set to the efficient one according to the changed positions of the pattern contours.

Additionally, updated cutting information can be written into the wireless tag $60_\alpha$ by the writing unit. Thus, the second embodiment can achieve the same advantageous effect as the first embodiment.

The foregoing embodiments described with reference to the accompanying drawings are not restrictive but may be modified or expanded as follows. The embodiment should not be limited to the cutting apparatus 1 as the cutting plotter. The embodiment may include various devices and apparatuses provided with respective cutting functions.

Although the wireless tag 60 is detachably affixed to the holding sheet 10 by the double-sided tape in the foregoing embodiments, the wireless tag 60 may be affixed to the holding sheet 10 by any means other than the double-sided tape. For example, the holding sheet may be provided with a recess in which the wireless tag 60 is detachably fitted.

The pressing unit may be any actuator such as an electric motor other than the solenoid 57, instead of the solenoid 57.

The memory 73 of the wireless tag 60 may store the cutter pressure information storage area 731, the pressing member pressure information storage area 732, the speed information storage area 733, the correction information storage area 734, contour data storage area 735, the cutting sequence data storage area 736 and the layout data storage area 737. Consequently, the predetermined pattern contours $F_a$ to $F_l$ can reliably be cut on the basis of the cutting parameters, contour data and the like read from the wireless tag $60_\alpha$ under proper cutting conditions in the cutting apparatus 1. Furthermore, the cutting information of the wireless tag 60 may include at least one of the cutting parameter and the contour data.

The cutting apparatus 1 is provided with a function of the cutting data processing device. The cutting data processing program stored in the cutting apparatus 1 as the cutting data processing device in a storage unit of PC80 may be stored in a computer-readable storage medium such as a USB memory, a CD-ROM, a flexible disc, a DVD or a flash memory. In this case, when data and a program may be read from the storage medium, the second embodiment can achieve the same advantageous effects s the first embodiment.

The control program stored in the storage unit of the cutting apparatus 1 may be stored in a storage medium which is computer-readable, such as a USB memory, a CD-ROM, a flexible disc, a DVD or a flash memory. In this case, when the control program stored in the storage medium is read into computers of various devices and apparatuses provided with respective cutting functions thereby to be executed, the same operation and the same advantageous effects as those described in the foregoing embodiments can also be achieved.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A cutting apparatus comprising:

a cutting unit including a cutting blade moved together with an object to be cut, relative to each other, thereby cutting the object by the cutting blade;

a holding member having an adhesive layer on which the object is removably held, the holding member being set onto the cutting apparatus while adhesively holding the object;

a wireless tag provided on the holding member and containing cutting information written thereon, the cutting information including information about a cutting operation;

a reading unit which reads the cutting information from the wireless tag when the holding member has been set on the cutting apparatus; and a control unit which controls the cutting unit based on the cutting information the reading unit has read from the wireless tag, wherein the cutting information includes at least one of a relative moving speed between the cutting blade and the object, a pressing force of the cutting blade against the object and an amount of correction which corrects an amount of relative movement of the cutting blade relative to the object; and wherein the cutting unit includes a pressing unit which presses the object held by the holding member, and the cutting information includes a pressing force of the pressing unit.

2. The apparatus according to claim 1, wherein the cutting information includes contour data for cutting a predetermined pattern contour.

3. The apparatus according to claim 2, wherein the cutting information includes layout data for laying out the pattern contour on the object.

4. The apparatus according to claim 2, wherein the cutting information includes cutting sequence data for specifying a cutting sequence of cutting a plurality of the pattern contours when the plural pattern contours are cut for the object.

5. The apparatus according to claim 1, further comprising a setting unit which updates the cutting information read from the wireless tag by the reading unit and a writing unit which writes into the wireless tag the cutting information updated by the setting unit.

6. The apparatus according to claim 1, wherein the wireless tag is detachably attached to the holding member.

7. A holding member for use with a cutting apparatus which includes a cutting unit cutting an object to be cut, a reading unit which reads cutting information by wireless communication and a control unit which controls the cutting unit based on the cutting information read by the reading unit, the holding member comprising:

an adhesive layer on which the object is removably held; and a wireless tag in which cutting information including information about a cutting operation is written, wherein the cutting information includes at least one of a relative moving speed between the cutting blade and the object, a pressing force of the cutting blade against the object and an amount of correction which corrects an amount of relative movement of the cutting blade relative to the object; and wherein the cutting unit includes a pressing unit which presses the object held by the holding member, and the cutting information includes a pressing force of the pressing unit.

8. The member according to claim 7, wherein the cutting information includes contour data for cutting a predetermined pattern contour.

9. The member according to claim 8, wherein the cutting information includes layout data for laying out the pattern contour on the object.

10. The member according to claim 8, wherein the cutting information includes cutting sequence data for specifying a cutting sequence of cutting a plurality of the pattern contours when the plural pattern contours are cut from the object.

11. The member according to claim 7, wherein the wireless tag is detachably attached to the holding member.

12. A storage medium which is computer-readable and stores a control program that is used for a cutting apparatus which includes a holding member set at a position opposed to a cutting blade and having an adhesive layer on which the object is removably held, a cutting unit moving the cutting blade and the holding member relative to each other, thereby cutting the object by the cutting blade and a reading unit reading information by wireless communication, the control program comprising:

a reading routine of reading the cutting information from the wireless tag by the reading unit when the holding member is set on the cutting apparatus; and a cutting control routine of controlling the cutting unit based on the cutting information read from the wireless tag in the reading routine.

13. The storage medium according to claim 12, wherein the control program further comprises:

a setting routine of updating the cutting information read from the wireless tag in the reading routine; and a writing routine of writing the cutting information updated in the setting routine into the wireless tag.

* * * * *